US010746493B1

(12) United States Patent
Steimke et al.

(10) Patent No.: US 10,746,493 B1
(45) Date of Patent: Aug. 18, 2020

(54) RECOIL ASSEMBLY FOR A MACHINE GUN

(71) Applicant: Sig Sauer, Inc., Newington, NH (US)

(72) Inventors: David Luke Steimke, Epping, NH (US); Jeffery John Melochick, Raymond, NH (US); Jason Knight, Exeter, NH (US); Thomas Ocasio, Manchester, NH (US); Jacqueline Kelly McNally, Rochester, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/543,773

(22) Filed: Aug. 19, 2019

(51) Int. Cl.

| | |
|---|---|
| ***F41A 9/29*** | (2006.01) |
| ***F41A 25/12*** | (2006.01) |
| ***F41A 3/26*** | (2006.01) |
| ***F41A 3/94*** | (2006.01) |
| ***F41A 5/18*** | (2006.01) |
| ***F41A 5/02*** | (2006.01) |
| *F41A 9/61* | (2006.01) |

(52) U.S. Cl.
CPC ..... *F41A 25/12* (2013.01); *F41A 3/26* (2013.01); *F41A 3/94* (2013.01); *F41A 5/02* (2013.01); *F41A 5/18* (2013.01); *F41A 9/29* (2013.01); *F41A 9/61* (2013.01)

(58) Field of Classification Search
CPC .... F41A 25/12; F41A 3/26; F41A 3/94; F41A 5/02; F41A 5/18; F41A 9/61; F41A 9/29
USPC ..... 89/42.01, 44.02, 44.01, 33.14
See application file for complete search history.

(56) References Cited

U.S. PATENT DOCUMENTS

| | | | | |
|---|---|---|---|---|
| 2,950,653 A | | 8/1960 | Harvey | |
| 3,110,221 A | | 11/1963 | Lochhead | |
| 3,198,076 A | | 8/1965 | Stoner | |
| 3,253,362 A | | 5/1966 | Gitchell | |
| 3,318,192 A | | 5/1967 | Miller et al. | |
| 3,595,128 A | | 7/1971 | Hoyt, Jr. | |
| 3,688,641 A | | 9/1972 | Curtis et al. | |
| 3,744,371 A | * | 7/1973 | McFarland | F41A 9/37 89/33.04 |

(Continued)

FOREIGN PATENT DOCUMENTS

| | | | | |
|---|---|---|---|---|
| FR | 2019-24181 G | * | 3/2019 | |
| GB | 141128 A | * | 4/1920 | F41A 9/76 |

(Continued)

OTHER PUBLICATIONS

Todd South, "Here's One of the Big Guns Competing to be SOCOM's Next Lightweight Medium Machine Gun", retrieved online, URL: https://www.armytimes.com/news/your-army/2019/01/24/heres-one-of-the-big-guns-competing-to-be-socoms-next-lightweight-medium-machine-gun/, Jan. 24, 2019, 5 pages.

(Continued)

*Primary Examiner* — John Cooper
(74) *Attorney, Agent, or Firm* — Finch & Maloney PLLC

(57) ABSTRACT

A receiver assembly for a rifle includes a receiver with a feed assembly configured for open-bolt operation. A feed cover is hingedly mounted to the receiver and includes a portion of the feed assembly, where the feed cover is movable between a closed position and an open position by pivoting about a hinge pin oriented along a longitudinal axis of the receiver. For example, the feed cover can pivot to one side of the receiver when in the open position. A rifle incorporating the receiver assembly is also disclosed.

20 Claims, 20 Drawing Sheets

(56) References Cited

U.S. PATENT DOCUMENTS

| | | | | |
|---|---|---|---|---|
| 3,766,821 | A * | 10/1973 | Cozzy | F41F 1/10 89/12 |
| 3,977,296 | A | 8/1976 | Silsby et al. | |
| 6,343,536 | B1 | 2/2002 | Rossier et al. | |
| 6,742,434 | B1 | 6/2004 | Dillon | |
| 7,131,367 | B1 | 11/2006 | Boerschig et al. | |
| 7,526,991 | B2 | 5/2009 | Steimke et al. | |
| 7,584,691 | B2 | 9/2009 | Steimke et al. | |
| 7,717,024 | B2 | 5/2010 | Steimke et al. | |
| 7,762,174 | B1 | 7/2010 | Steimke et al. | |
| 8,794,121 | B2 | 8/2014 | Steimke et al. | |
| 8,919,238 | B2 | 12/2014 | Steimke et al. | |
| 9,383,156 | B2 | 7/2016 | Steimke et al. | |
| 9,587,895 | B1 | 3/2017 | Abbott | |
| 9,618,284 | B1 * | 4/2017 | Hoffman | F41A 7/08 |
| 9,719,746 | B1 | 8/2017 | Lyman et al. | |
| 2003/0126781 | A1 * | 7/2003 | Herring | F41A 5/26 42/18 |
| 2005/0011346 | A1 | 1/2005 | Wolff et al. | |
| 2008/0236379 | A1 | 10/2008 | Steimke et al. | |
| 2010/0170385 | A1 | 7/2010 | Steimke et al. | |
| 2013/0047828 | A1 * | 2/2013 | Smith | F41A 9/01 89/33.14 |
| 2013/0047833 | A1 | 2/2013 | Steimke et al. | |
| 2013/0074390 | A1 | 3/2013 | Wossner et al. | |
| 2013/0125440 | A1 | 5/2013 | Zheng | |
| 2014/0076145 | A1 | 3/2014 | Steimke et al. | |
| 2014/0331853 | A1 | 11/2014 | St. George | |
| 2017/0010064 | A1 | 1/2017 | Karagias | |
| 2019/0339032 | A1 * | 11/2019 | Barrett | F41A 3/66 |

FOREIGN PATENT DOCUMENTS

| | | | |
|---|---|---|---|
| WO | 2013058860 | A2 | 4/2013 |
| WO | 2013058860 | A3 | 4/2013 |
| WO | 2013058861 | A3 | 4/2013 |

OTHER PUBLICATIONS

David Crane, Sig Sauer SL Mag .338 Norma Magnum (NM) Lightweight Belt-Fed Machine Gun With Recoil Attenuation/Mitigation System and Lase-And-Engage Technology Electro-Optical Combat Optic/Laser Sight!, Jan. 28, 2019, 6 pages. retrieved online, URL: http://www.defensereview.com/sig-sauer-sl-mag-338-norma-magnum-nm-lightweight-belt-fed-machine-gun-with-recoil-attenuation-mitigation-system.

Rao Yalamanchili, US Army Armament Research and Development Command, "New Concepts in Recoil Mechanisms", 20 pages, (DTIC Oct. 20, 1980).

PCT Search Report and Written Opinion for PCT Application No. PCT/US19/29167, dated Sep. 13, 2019, 17 pages.

* cited by examiner

RECOIL ASSEMBLY FOR A MACHINE GUN

FIELD OF THE DISCLOSURE

The present disclosure relates to firearms, and more particularly to a recoil assembly and a feed assembly for a rifle.

BACKGROUND

Firearms, such as rifles and other small arms, are often used by military squads. Rifles can be configured with select fire modes that include semi-automatic, burst fire, and full-automatic fire. Depending on the intended use, rifles can be can be shoulder fired, fired in a prone position with a bipod, or mounted to a vehicle, to name a few examples. The intended use and configuration can also determine the type of ammunition used with the firearm, the overall size and weight of the firearm, and options for accessories.

SUMMARY OF THE DISCLOSURE

Embodiments of the present disclosure relate generally to firearms subassemblies and rifles incorporating the same. Aspects of the present disclosure include a recoil assembly for a machine gun with an open bolt configuration, a machine gun or other firearm incorporating the recoil assembly, a bolt and bolt actuator assembly. Another aspect of the present disclosure is a feed cover for a machine gun, where the feed cover folds open to the side of the receiver. Additional aspects of the present disclosure exist and will be described herein and which will form the subject matter of the attached claims. These and various other advantages, features, and aspects of the embodiments will become apparent and more readily appreciated from the following detailed description of the embodiments taken in conjunction with the accompanying drawings.

Figure 1:
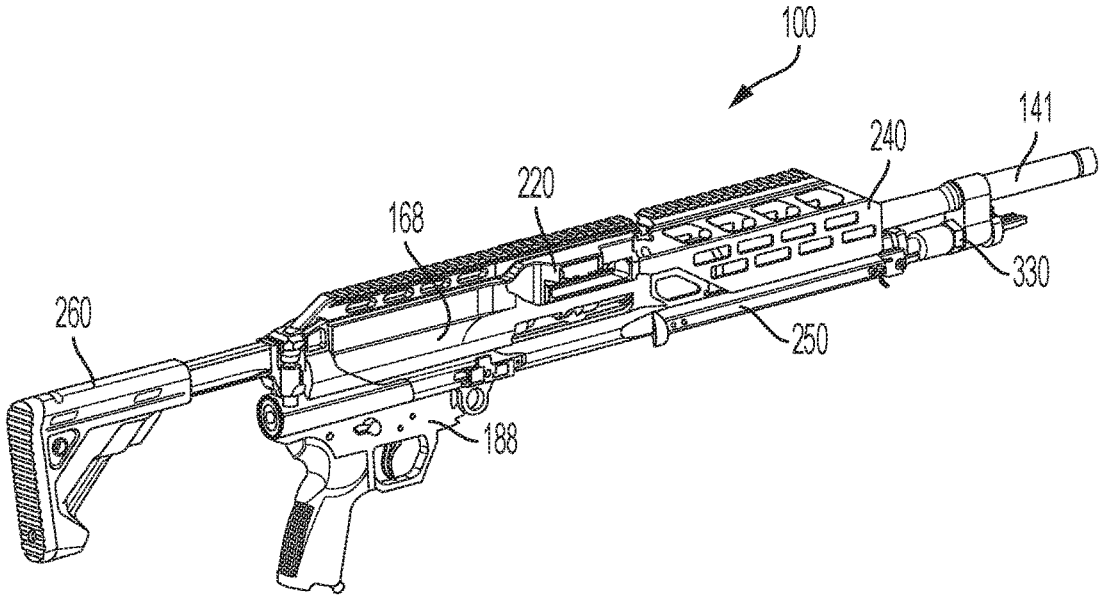
FIG. 1 is a rear perspective view showing the right side of a rifle having an open bolt configuration, where the feed cover is in the closed position, a bipod is in a folded position, and a gas piston assembly is mounted to the barrel of the rifle, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

The present disclosure is generally directed to a recoil assembly, bolt group, and other components of a rifle configured for use in a semi-automatic and/or automatic firearm, such as a machine gun or squad rifle. In one embodiment, the firearm includes a recoil assembly with a barrel assembly and hydraulic buffer assembly that are soft-mounted to the barrel assembly. For example, the barrel extension engages, either directly or indirectly, the hydraulic buffer assembly that is offset from the barrel extension and bore axis. The bolt group is coupled to an operational rod ("op-rod") and op-rod spring. Upon firing the rifle, pressurized gases displace the op-rod to move the bolt and bolt actuator rearward to a recoil position. Recoil forces also move the barrel extension rearward. The op-rod spring and the buffer assembly can be arranged to act in parallel or in series with one another, in accordance with some embodiments. Recoil forces can be dissipated by a combination of counteracting forces acting on the bolt group and on the barrel assembly, thereby reducing felt recoil to the operator among other advantages.

In one example embodiment, a recoil assembly for a rifle includes a receiver defining a longitudinal opening therethrough. A barrel is fixedly attached to a distal end of a barrel extension, such as with a barrel nut or barrel lock, where the barrel defines a bore with a bore axis. The barrel extension is movably received in the firearm's receiver, such as in a free-floating configuration. In accordance with one embodiment, a hydraulic buffer assembly is offset from the barrel extension in a rear portion of the firearm's lower receiver or trigger housing. In one embodiment, the hydraulic buffer assembly is free floating between an aft stop housed in the buffer and a forward stop in the breach lug. For example, the hydraulic buffer assembly is positioned vertically below the proximal end portion of the barrel extension and includes a hydraulic buffer and a buffer spring coiled around the outside of the hydraulic buffer. A bolt actuator and bolt can move axially along the inside of the barrel extension between a recoil position and a battery position. A gas piston assembly mounted on the barrel includes a gas piston and an op-rod coupled to the bolt actuator. When the rifle is fired, pressurized gases displace the op-rod to move the bolt and bolt actuator rearward against counteracting forces of the op-rod spring. Recoil forces also move the barrel extension rearward against counteracting forces of the hydraulic buffer assembly. In some embodiments, the bolt actuator is also coupled to the hydraulic buffer by a spring guide or actuator rod extending between the bolt actuator and the hydraulic buffer. For example, the op-rod spring and the hydraulic buffer assembly are aligned and located below the barrel and barrel extension, where the hydraulic buffer and op-rod spring are arranged in series to act on the bolt actuator. The proximal end portion of the barrel extension engages the buffer spring. In some embodiments, the barrel extension provides a rearward stop for the bolt actuator as the op-rod moves rearwardly, allowing a transfer of momentum from the bolt group to the barrel assembly. Recoil forces acting on the barrel assembly and the bolt group can be dissipated by a combination of counteracting forces of the hydraulic buffer assembly and op-rod spring. Some such recoil assemblies can be employed in a machine gun having an open bolt configuration, for example.

In another example embodiment, the op-rod spring is located between the op-rod and a proximal end portion of a lower receiver. For example, the op-rod is located above and extends along the barrel to a connector that engages the bolt actuator. A spring guide with op-rod spring extends rearwardly from the connector to the proximal end portion of the lower receiver. The barrel extension engages the hydraulic buffer assembly, which resists rearward movement of the barrel group in parallel with the op-rod spring resisting rearward movement of the bolt group. This arrangement also dissipates recoil forces acting on the barrel assembly and the bolt group are by using a combination of counteracting forces provided by the hydraulic buffer assembly and op-rod spring. Some such embodiments can be employed in a rifle with a closed bolt configuration, for example.

In some embodiments, features of the barrel extension guide the axial movement and rotation of the bolt, in contrast to other assemblies in which the bolt is received in and guided by a bolt carrier. In some embodiments, the operational rod is pivotably connected at its proximal end portion to the bolt actuator, such as via a cylindrical interface. In some such embodiments, the bolt actuator and op-rod function as a push-pull mechanism to translate the bolt axially within the barrel extension, where the barrel extension guides the movement and rotation of the bolt.

Another aspect of the present disclosure is directed to an assembly of a bolt and a bolt actuator. In one embodiment, the bolt assembly includes a bolt coupled to a bolt actuator, where the distal end portion of the bolt actuator is received in the proximal end portion of the bolt so as to permit relative axial and rotational movement between the bolt and the bolt actuator. Such an arrangement is unlike the bolt and bolt carrier used in some rifles where the bolt is received in the bolt carrier. The bolt and bolt actuator assembly (e.g., "bolt group") are slidably received in the barrel extension. In some embodiments, the bolt actuator defines a helical slot. In some such embodiments, a cam pin can be installed transversely through the bolt and through the helical slot so that the bolt moves axially and rotates with respect to the bolt actuator when the cam pin moves along the helical slot. The bolt is guided by features of the barrel extension. For example, as the bolt moves rearward from battery, an ejector occupies an ejector slot along the body of the bolt and bolt actuator, thereby preventing rotation of the bolt. As the bolt moves forward to a battery position, a recessed portion of bolt clears the ejector, allowing the bolt to rotate. Guiding the movement of the bolt by the barrel extension, rather than by a bolt carrier, allows for looser tolerances in the bolt, barrel extension, and other components of the rifle.

In accordance with some embodiments, the arrangement of the bolt actuator and bolt allows for larger lugs on the bolt. Also, the increased length of the barrel extension in the lug area allows for stronger locking lugs to resist higher chamber pressure. With higher pressure rounds (e.g., ~85K psi) the additional energy of combustion is mitigated by the buffer assembly, which absorbs energy of the bolt actuator and barrel assembly. The floating barrel and barrel extension being coupled to the buffering system substantially isolates the large firing impulse from reaching the receiver and the shooter. As a result, the felt recoil is significantly reduced for improved comfort and shooting precision.

General Overview

The lethality of the 5.56×45 cartridge currently used in military squad rifles is considered inadequate in some circumstances. For example, the use of improved body armor reduces penetration of the projectile, particularly for long-range shots. One possible approach is to change the ammunition design. For example, some ammunition can be made larger in size to achieve increased muzzle velocity to more effectively penetrate body armor, for example. In another example, ammunition compliant with the current maximum chamber pressure of about 62,000 psi can modified to improve the ballistic coefficient, trajectory, and shape of the projectile. Some such ballistic improvements, however, require a larger gun (e.g., a larger chamber).

Another possible approach is to use ammunition that produces a higher chamber pressure. For example, one ammunition produces a peak chamber pressure of up to 80,000-90,000 psi or more. To reliably fire ammunition with such chamber pressures, however, the rifle must be modified to accommodate the higher chamber pressures. These changes include not only addressing the increased chamber pressure, but also addressing felt recoil forces, the overall size and weight of the firearm, and other non-trivial design limitations. For example, while increases in size can be used to accommodate greater chamber pressures, such increases come with increased weight and may exceed the rifle's weight limitations for use by soldiers. For this reason and as a general matter, it is desirable to reduce or limit the weight of firearms and/or the ammunition in order to reduce the burden on the operator. Accordingly, a need exists for improvements to recoil assemblies and other subassemblies of a rifle configured for semi-automatic and/or full-automatic fire, including machine guns and other firearms. Various embodiments of the present disclosure address this need and others.

In one aspect of the present disclosure, a recoil assembly is configured for an open-bolt machine gun that operates with belt-fed ammunition. In another aspect, a recoil assembly is configured for a closed-bolt rifle that uses a fixed magazine, such as a detachable box magazine. In a further aspect, a bolt and bolt actuator assembly are disclosed. In yet another aspect of the present disclosure, a feed mechanism and bolt assembly for a machine gun is disclosed. In accordance with some embodiments of the present disclosure, a rifle and its subassemblies may exhibit one or more advantageous features that include reduced overall weight, a shorter overall length, a collapsible stock that can be folded along either side of the receiver, reduced felt recoil, and greater chamber pressures, to name a few examples. Numerous variations, configurations, and embodiments will be apparent.

As discussed herein, terms referencing direction, such as upward, downward, vertical, horizontal, left, right, front, back, etc., are used for convenience to describe embodiments of a rifle in a conventional orientation with the barrel extending horizontally. Embodiments of the present disclosure are not limited by these directional references and it is contemplated that firearm assemblies in accordance with the present disclosure could be used in any orientation.

Also, it should be noted that, while generally referred to herein as a 'recoil assembly' for consistency and ease of understanding the present disclosure, the disclosed recoil assemblies are not limited to that specific terminology and alternatively can be referred to, for example, as a buffer assembly, recoil buffer system, or other terms. Also, while generally referred to herein as an 'op-rod spring' for consistency and ease of understanding the present disclosure, the disclosed op-rod spring is not limited to that specific terminology and alternatively can be referred to, for example, as a recoil spring or other terms. As will be further appreciated, the particular configuration (e.g., materials, dimensions, etc.) of recoil assemblies, a bolt group, a barrel assembly, a feed assembly, stocks, and hydraulic buffer assemblies configured as described herein may be varied, for example, depending on whether the intended use is military, tactical, or civilian in nature. Still further, although rifles and their subassemblies may be described in an assembled form, the components of a given subassembly or the rifle as a whole can be provided in disassembled form, such as a kit or a group of unassembled replacement parts. Numerous configurations will be apparent in light of this disclosure.

Example Structures

Figure 2:
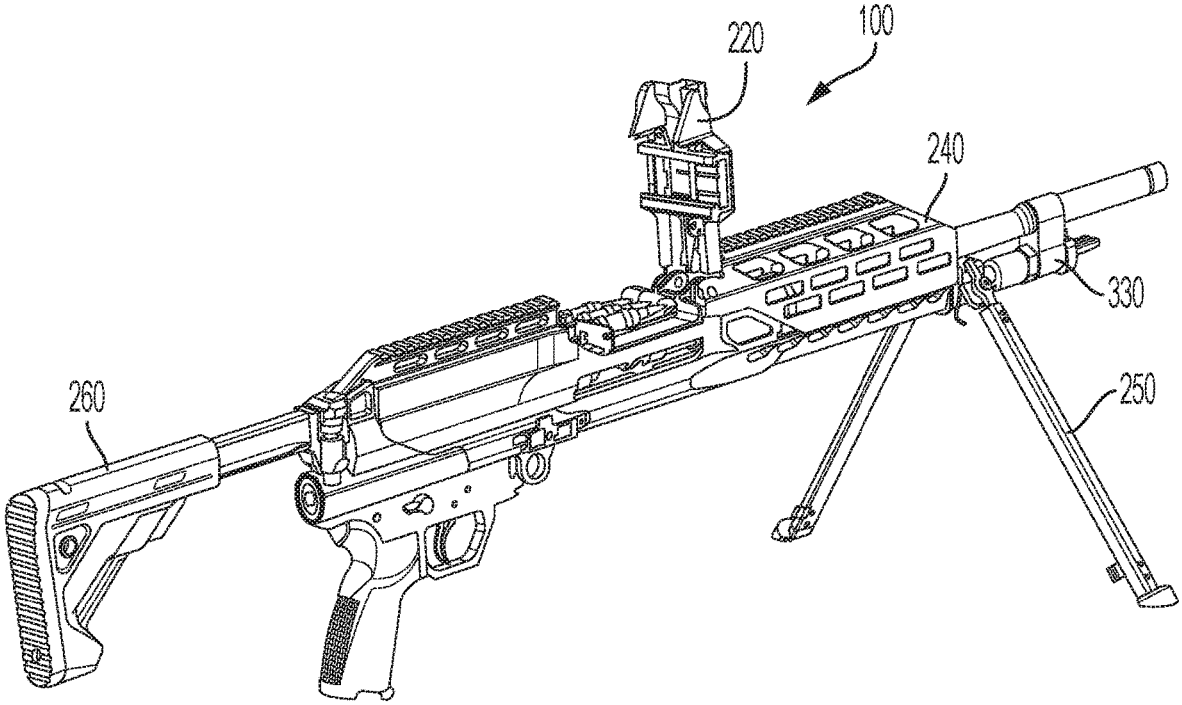
FIG. 2 is a rear perspective view of the right side of the rifle of FIG. 1, showing the feed cover in an open position and the bipod in the open position, in accordance with an embodiment of the present disclosure.

FIGS. 1-2 illustrates a perspective views of a rifle 100, in accordance with an embodiment of the present disclosure. FIG. 1 shows the right side of the rifle 100, which includes a trigger housing 188 assembled with a receiver 168. A handguard 240 is attached to the receiver 168 and extends along the barrel 141. A foldable stock 260 is attached to a rear end of the trigger housing 188. As shown in FIGS. 1-2, the rifle 100 is configured as a machine gun with an open bolt and left-hand belt ammunition feed. A gas block 330 mounted on the barrel 141 has a three-position gas valve for use in suppressed, normal, and adverse conditions. In some embodiments, the rifle 100 includes fire selection and other controls similar to those found on the M16 and AR-15-type rifle platforms, for example. As shown in FIG. 1, the feed cover 220 is closed, the stock 260 is deployed and adjusted to an extended position.

FIG. 2 illustrates the right side of the rifle 100 of FIG. 1 shown with the feed cover 220 in an open position and the bipod 250 in an open position, in accordance with one embodiment. A bipod 250 can be attached to the receiver 168. In one example embodiment, both legs of the bipod fold along the lower right and lower left edge of the handguard 240. In some embodiments, the bipod 250 is conformal to the receiver 168 to aid in protecting the user from heat of the barrel 141 during use.

Figure 3:
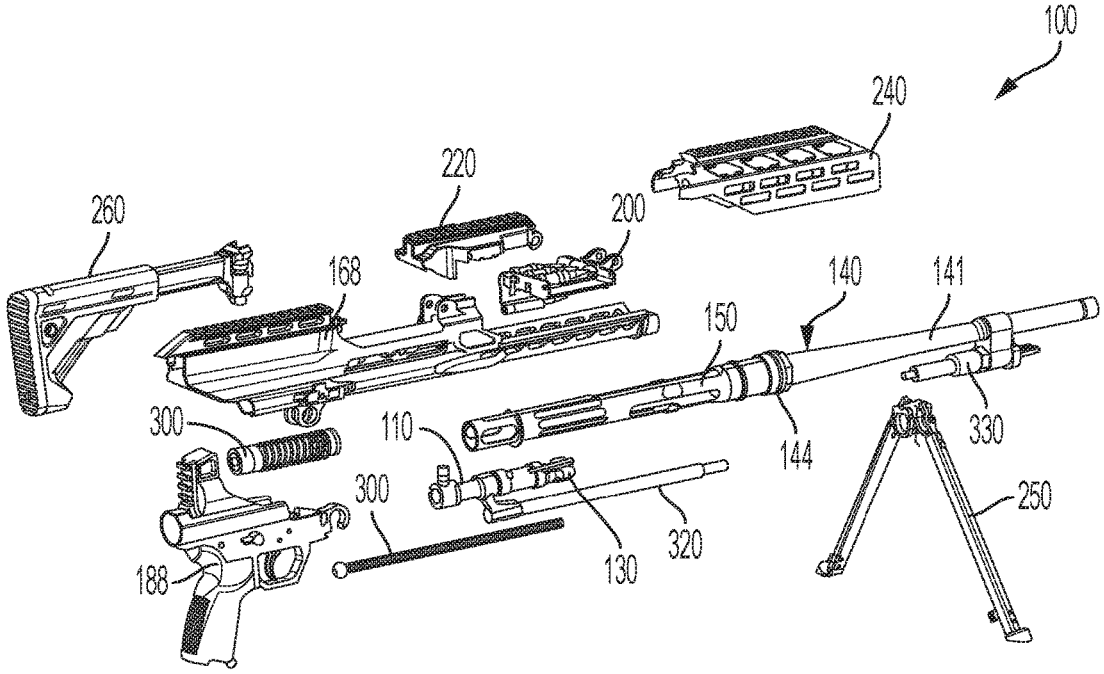
FIG. 3 is an exploded perspective view showing the top, right, and rear sides of some components of the rifle of FIGS. 1-2, in accordance with an embodiment of the present disclosure.

FIG. 3 illustrates an exploded, perspective view showing the right and rear sides of various components of the rifle 100 of FIGS. 1-2, including a bolt actuator 110 and bolt 130, a barrel group or barrel assembly 140, the receiver 168, the trigger housing 188, a feed tray 200 and feed cover 220, the hand guard 240, the conformal bipod 250, the adjustable and foldable stock 260, a buffer assembly 300, and the gas piston 330. In one embodiment, the barrel assembly 140 includes a barrel 141 secured to a barrel extension 150 by a barrel nut 144, and a gas block 330 mounted on the barrel 141. Components of the rifle 100 will be discussed in more detail below.

Figure 4:
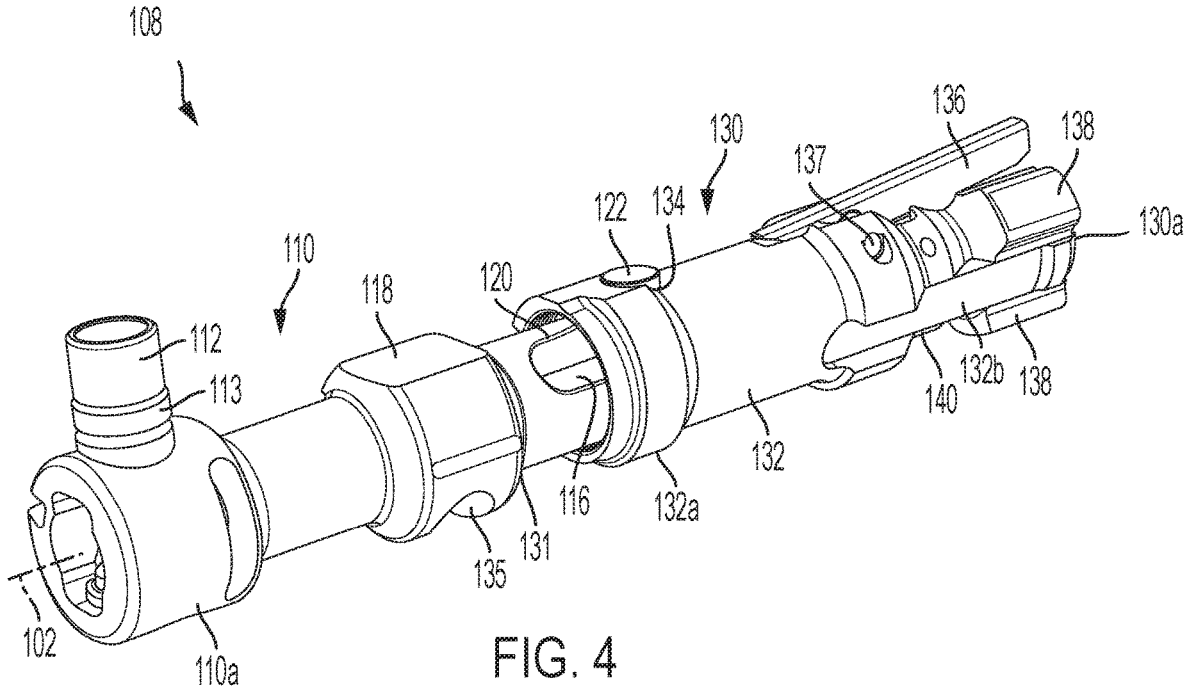
FIG. 4 is a perspective view showing the top, right, and rear sides of a bolt group that includes a bolt and a bolt actuator coupled together, where the bolt actuator is partially received in the bolt, in accordance with an embodiment of the present disclosure.

Referring now to FIG. 4, a perspective view shows the top, right, and rear sides of a bolt group 108 that includes a bolt actuator 110 and bolt 130, in accordance with an embodiment of the present disclosure. The bolt actuator 110 has a generally cylindrical shape that extends from a proximal end portion 110*a* to a distal end portion 110*b* along a bore axis 102 of the rifle 100. In one embodiment, such as when the bolt actuator 110 is configured for use with an open-bolt feed mechanism, the bolt actuator 110 includes a feed cam roller 112 attached to and extending up from a proximal end portion 110*a*. In one embodiment, the feed cam roller 112 has a cylindrical shape and is constructed to roll or slide along a feed cam 210 (shown in FIG. 9) as the action cycles. In some such embodiments, an anti-torque roller 114 is positioned below the feed cam roller 112 as a single structure with the feed cam roller 112. For example, the anti-torque roller 114 has a larger diameter than the feed cam roller 112 and functions as a stop to maintain and guide the vertical position of the feed cam roller 112 in the feed cam 210 as the bolt actuator 110 moves axially. In other embodiments, the bolt actuator 110 is coupled to an operational rod 320 or like structure (shown in FIG. 3).

The distal end portion 110*b* of the bolt actuator 110 is slidably received in the bolt 130. A firing pin 116 (shown partially) extends axially through the bolt actuator 110 and bolt 130 and is configured to strike the ammunition primer. In some embodiments, the firing pin 116 has a fixed position with respect to the bolt actuator body 118, such as when the bolt is configured for a machine gun. In other embodiments, the firing pin is movable and pulling the trigger releases a hammer that strikes the firing pin 116 to move it through an axial opening in the bolt 130 to strike the primer of the ammunition cartridge. The distal end portion 110*b* of the bolt actuator 110 defines a helical slot 120 that accepts a cam pin 122 installed between the bolt actuator 110 and the bolt 130. As the bolt actuator 110 moves axially with respect to the bolt 130, the helical slot 120 causes the bolt 130 to rotate about the bore axis 102 (e.g., about 45°).

In accordance with some embodiments, the firing pin 116 is housed in the bolt actuator 110. The firing pin 116 is preloaded rearward against a surface in the proximal end portion 110*a* of the bolt actuator 110 and is allowed to move forward approximately 0.05 inch. For example, once the bolt 130 is locked with the barrel extension 150 and before the bolt actuator 110 stops against the bolt 130, the tip of the firing pin 116 protrudes from the bolt face 130*a* delivering energy to the ammunition primer by being tightly coupled to the bolt actuator 110, which has forward momentum. This coupling between the firing pin 116 and the bolt actuator 110 also supports the primer in the cartridge at the peak pressure, which eliminates or reduces the risk of primer piercing.

The bolt 130 has a generally cylindrical shape that extends along the bore axis 102 from a proximal bolt end portion 132*a* to a distal bolt end portion 132*b*. The proximal bolt end portion 132*a* has a hollow bolt body 132 that slidably receives the bolt actuator 110 therein. The bolt 130 is coupled to the bolt actuator 110 by the cam pin 122 extending through a cam pin opening 134 in the bolt 130 and through the helical slot 120 in the bolt actuator 110. When the bolt actuator 110 and the bolt 130 move axially with respect to each other, the helical slot 120 in the bolt actuator 110 causes the bolt 130 to rotate about the bore axis 102. Such rotation occurs in one direction, for example, when the bolt 130 is moved distally into battery and the bolt actuator 110 is advanced axially into the bolt 130. The bolt 130 rotates in an opposite direction when the bolt 130 and bolt actuator 110 return proximally after firing. For example, the bolt actuator 110 returns proximally at a faster rate than the bolt 130, resulting in axial movement between the bolt 130 and bolt actuator 110 and in turn causing rotation of the bolt 130.

The bolt actuator body 118 defines a transverse slot 135, such as notch or recess, for connection to the op-rod 320, which will be discussed in more detail below. For example, the transverse slot 135 is defined in a lower surface and interfaces with an op-rod 320 extending from a gas block on the lower portion of the barrel 141. The transverse slot 135 can be configured as part of a pivot, hinge, or ball joint with the op-rod 320 or component attached to the op-rod 320. In other embodiments, the transverse slot 135 is positioned on a top surface of the bolt actuator 110, such as when the gas piston is on the top of the barrel 141. In one embodiment, the bolt actuator 110 defines a shoulder 131, such as a taper or frustoconical surface, on the bolt actuator 110 such that the forward motion of the bolt actuator 110 is stopped at a corresponding mating surface on the bolt 130. The angle of the shoulder 131 is designed to reduce the rebound energy between the bolt 130 and the bolt actuator 110, as will be appreciated.

In some embodiments, the proximal bolt end portion 132*a* includes a rammer 136 that protrudes upward from and extends axially along a top surface of the bolt 130. In some embodiments, the rammer 136 can pivot to some extent about a rammer pin 137 extending transversely through a top portion of the bolt 130. The rammer 136 is generally configured to engage the head of cartridges on the feed tray 200 during the loading sequence. For example, the rammer 136 functions to strip a cartridge from the feed position on the feed tray 200 and advance the cartridge into the feed guide where it drops into position to be engaged by the lugs 138 when the bolt 130 moves the cartridge into battery. By pivoting about the rammer pin 137, the rammer 136 can follow the head of the cartridge as it moves to alignment with the lugs 138.

As the bolt 130 moves to battery, lugs 138 on the distal bolt end portion 132*b* engage the head of a cartridge and push the cartridge into battery. For example, the bolt 130 defines two, three, four, or other number of lugs 138 that are spaced circumferentially about the distal bolt end portion 132*b*. After the rammer 136 pushes a cartridge from the feed tray 200 towards the chamber, the distal bolt end portion 132*b* engages the cartridge head and moves into battery. In some embodiments, the distal bolt end portion 132*b* includes an ejector 139 along a lower portion to engage the cartridge rim and eject a spent cartridge from the chamber when the bolt 130 moves rearward after firing.

Unlike other bolt groups, in one embodiment the bolt actuator 110 and bolt 130 of the present disclosure are unique in that the bolt actuator 110 is received in the bolt 130, rather than the other way around. An advantage of such an arrangement is that the bolt 130 can be larger and feature larger lugs 138 compared to traditional designs. Such a configuration can be used in a chamber configured for pressures above 62,500 psi, as will be appreciated. Also, unlike the bolt-carrier group of some rifles, the bolt 130 and bolt actuator 110 in accordance with some embodiments of the present disclosure are different in that the bolt 130 is guided exclusively by the barrel extension 150, rather than by the bolt carrier, as the bolt 130 moves between the recoil position and the battery position. In such a configuration, the bolt actuator 110 simply moves the bolt back and forth axially, but the bolt 130 is guided axially and rotationally by the barrel extension 150. When the rifle 100 is charged and ready to fire, for example, the bolt 130, bolt actuator 110, and op-rod 320 are retained in the recoil or rearward position by engagement between the trigger and the sear. When the trigger is pulled, the bolt 130, bolt actuator 110, and op-rod 320 move forward, pushing the round 20 out of the link via the rammer 136 and into the chamber. In conjunction with this action, the bolt actuator 110 has a feed cam roller 112 that moves along a feed cam 210 (shown in FIG. 8). The feed cam 210 moves laterally from one side to the other as a result of the forward motion of the bolt actuator 110. This lateral movement indexes the next round in to the strip position for chambering by the rammer 136. As the bolt 130 moves into and locks with the barrel extension 150, it is guided further forward to the battery position while the barrel extension 150 moves forward to the battery position.

Figure 5:
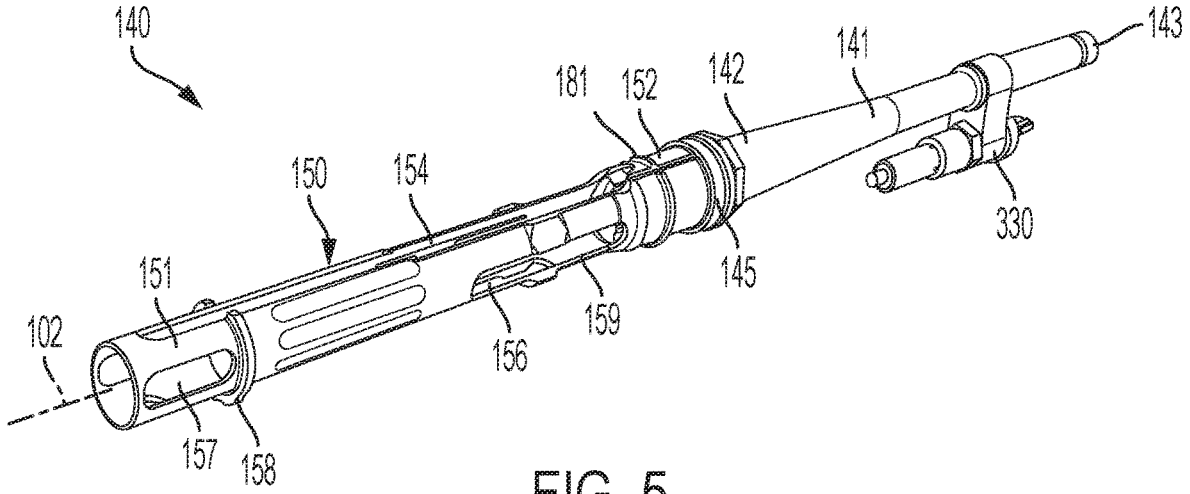
FIG. 5 is a perspective view showing the top, right, and rear sides of a barrel assembly that includes a barrel and gas block, where the barrel is secured to the barrel extension with a barrel lock, in accordance with an embodiment of the present disclosure.

Referring now to FIG. 5, a perspective view shows top, right, and rear sides of a barrel assembly 140, in accordance with an embodiment of the present disclosure. As shown in this example, the barrel assembly 140 includes a barrel 141 secured to a barrel extension 150 with a barrel nut 144. The barrel assembly 140 also includes a gas block 330 on the barrel 141. The barrel 141 extends longitudinally along the bore axis 102 and has a proximal barrel end 142 secured to the barrel extension 150 via a barrel lock 145. The gas block 330 is mounted to the barrel 141 between the proximal barrel end 142 and the distal barrel end 143. In one embodiment, the gas block 330 connects to a gas port in the barrel 141 located from 9 to 11 inches from the proximal barrel end 142. Other locations along the barrel 141 can be used, depending on the desired operational pressure for the gas block. In one example, the gas block 330 is located to provide a gas pressure to the gas port of about 33,000 psi upon discharging the rifle 100.

The barrel extension 150 has a hollow cylindrical shape that is configured to slidably receive the bolt actuator 110 and bolt 130 therein. The distal portion 152 connects to the barrel 141. In one embodiment, the barrel extension 150 defines a top slot 154 extending longitudinally along the top surface. In one embodiment, the feed cam roller 112 on the bolt actuator 110 extends through the top slot 154 when the bolt actuator 110 moves axially through the barrel extension 150. In other embodiments, a connector 111 between the op-rod 320 and the bolt actuator 110 extends through the top slot 154. The barrel extension 150 also defines a bottom slot 156 extending longitudinally along a bottom surface. In one embodiment, the connector 111 on the op-rod 320 extends through the bottom slot 156 to connect to the transverse slot 136 in the bolt actuator 110. In some embodiments, a proximal portion 151 defines one or more side slots 157. An ejection port 159 is defined in the barrel extension 150 adjacent the distal portion 152. In one embodiment, the ejection port 159 is positioned along a lower side portion.

A protrusion 158, such as a flange or rib, extends circumferentially around an outside of at least a portion of the barrel extension 150 adjacent the barrel proximal end portion 151. The protrusion 158 can be a flange or like structure that extends radially outward and is configured to engage the actuator 114 at the distal end of a hydraulic buffer 302. For example, the protrusion 158 is shaped to engage the actuator 114 and/or the distal end of the hydraulic buffer 302. As such, axial energy of the barrel assembly 140 can be transferred to and dissipated by the buffer spring 304 and/or the hydraulic buffer 302 of the hydraulic buffer assembly 300 (FIG. 7).

In contrast to some barrel assemblies 140, the barrel extension 150 is somewhat longer and is movably received through the distal end of the receiver 168. As such, the barrel extension 150 can move axially relative to the receiver 168 when the rifle 100 is fired. As noted above, the barrel extension 150 is coupled to the hydraulic buffer assembly 300, which resists forward and rearward travel of the barrel extension 150. In some embodiments, the rifle 100 can be fired on runout of the barrel extension 150, in which the barrel extension 150 is allowed to continue moving forward as the bolt 130 locks into the barrel extension 150 at the breech and the shot is fired. In some embodiments, the forward motion of the barrel assembly 140 is stopped by a battery lug 176 (shown in FIG. 10) attached to or integral to the receiver 168. For example, the battery lug 179 engages a protrusion 181 on the barrel extension 150 to define a stop block that provides a consistent position of the barrel 141 from shot to shot. In some such embodiments, the receiver 168 (and/or the barrel extension 150) also includes a surface 176*a* that biases the barrel extension 150 downward to maintain the same barrel start position for accurate firing.

Figure 6:
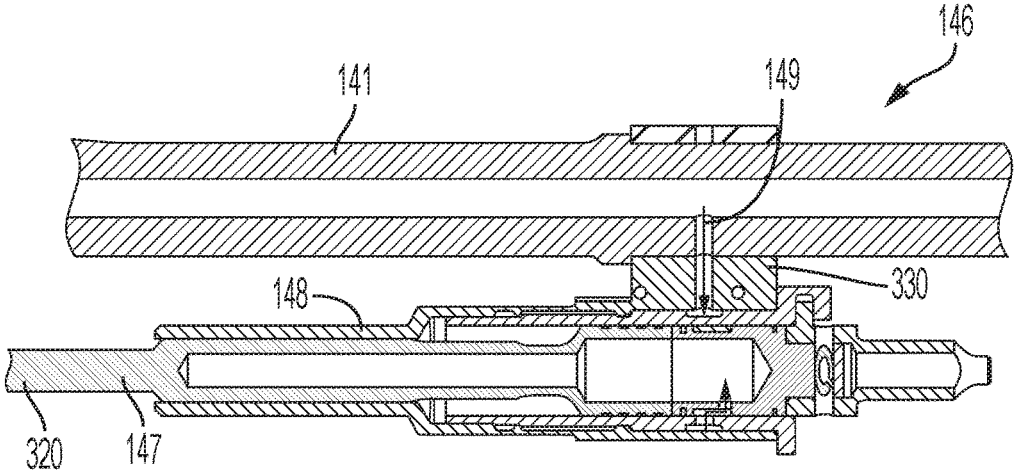
FIG. 6 is a cross-sectional view showing a portion of the barrel and gas piston assembly of FIG. 5, in accordance with an embodiment of the present disclosure.

Referring now to FIG. 6, a cross-sectional view illustrates the gas piston assembly 146 installed on the barrel 141, in accordance with an embodiment of the present disclosure. The gas piston assembly 146 includes a gas block 330 installed over a gas port 149 in the barrel 141. A gas piston 147 is displaceable from a piston housing 148 in response to pressurized gases at the gas port 149 of the barrel 141. Upon firing the rifle 100, pressurized gases cause the piston 147 to displace rearwardly and actuate the op-rod 320 to drive the bolt actuator 110 and bolt 130 rearwardly.

Figure 7:
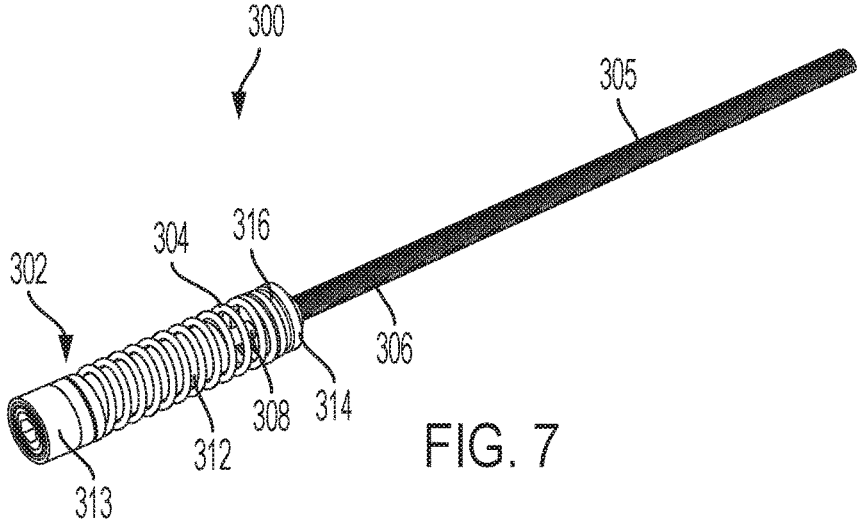
FIG. 7 is a perspective view showing the top, right, and rear sides of a hydraulic buffer assembly that includes a hydraulic buffer, a buffer spring, and a spring guide with an op-rod spring, in accordance with an embodiment of the present disclosure.

Referring now to FIG. 7, a side and rear perspective view illustrates a buffer assembly 300, in accordance with an embodiment of the present disclosure. In one embodiment, the buffer assembly 300 includes a hydraulic buffer 302 with a buffer body 312. In some embodiments, the hydraulic buffer includes a buffer spring 304 installed around the outside of the buffer body 312, such as between a proximal end portion 313 and a distal end portion or actuator 314. In some embodiments, the buffer spring 304 is located within the buffer body 312. In one embodiment, the actuator 314 has a disc shape with a circumferential slot 316 extending along its perimeter. The circumferential slot 316 can be configured to engage the protrusion 158 on the barrel extension 150. An op-rod spring 306 extends along a spring guide 305 that is received in the proximal end of the op-rod 320. In some embodiments, the op-rod 320 impacts the front of a spring guide 305 aligned with and engaging the hydraulic buffer 302 to dissipate rearward energy of the op-rod 320 through the same hydraulic buffer assembly 300 acting on the barrel extension 150. In other embodiments, the op-rod 320 extends through the connector 111 to the actuator 114, where the op-rod spring 306 is coiled around part of the op-rod 320 between the actuator 314 and the connector 111.

The housing or buffer body 312 defines an inner cavity along which the buffer piston 308 is movable between an extended position and a depressed position. The buffer spring 304 biases the buffer piston 308 towards the extended position. An accumulator (not visible) is disposed in a first fluid chamber, where movement of the buffer piston 308 causes hydraulic fluid contained in a second fluid chamber to be displaced to the first fluid chamber containing the accumulator.

In an embodiment, the hydraulic buffer 302 distributes the high energy recoil load over a greater stroke by pumping fluid through the piston 308 via controlled holes. For example, the buffer stroke is approximately ¾ of an inch, which is sufficient to slow down and stop the reward movement of the barrel assembly 140 and/or bolt actuator 110. The buffer spring 304 also aids in absorbing the recoil energy. At the end of its stroke the buffer spring 304 pushes the barrel assembly 140 back into battery.

Figure 8:
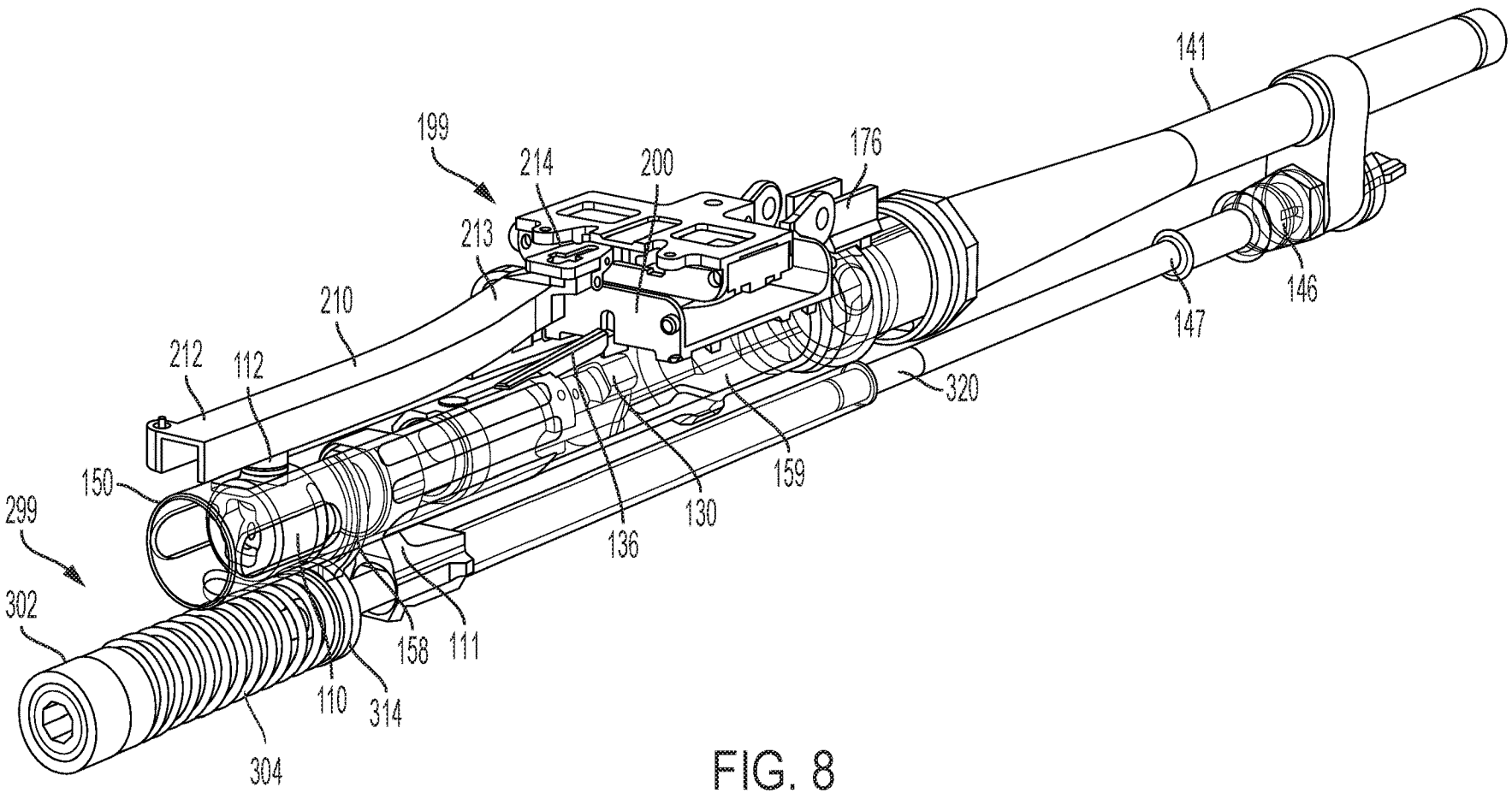
FIG. 8 is a perspective view showing the top, right, and rear sides of a feeding assembly and recoil assembly component groups of a machine gun, including an ammunition feed assembly, a hydraulic buffer assembly, a barrel assembly, a bolt group in the barrel extension, in accordance with an embodiment of the present disclosure.

Referring now to FIG. 8, a perspective view illustrates top, right, and rear sides of components of a recoil assembly 299 and a feed assembly 199, as may be used in a rifle 100 with an open bolt configuration, in accordance with an embodiment of the present disclosure. The recoil assembly 299 includes the buffer assembly 300 aligned with and engaging the op-rod 320. The hydraulic buffer assembly 300 engages the barrel extension 150. The barrel extension 150 is also loosely coupled to the hydraulic buffer by the op-rod 320. For example, as the connector moves rearwardly, it contacts the barrel extension 150 and transfers rearward momentum to the barrel assembly 150, which is absorbed by the hydraulic buffer 304. The op-rod 320 also aligns with and engages (directly or indirectly) the piston 147 of the gas piston assembly 146. As such, the op-rod spring 306 and hydraulic buffer assembly 300 operate together in series to absorb recoil forces of both the bolt group 108 and the barrel assembly 140.

Prior to firing, the bolt actuator 110, bolt 130, barrel 141, and barrel extension 150 start from a rearward position (hence "open bolt" configuration) in which the op-rod spring 306 and the hydraulic buffer assembly 300 are compressed, in accordance with some embodiments. In the moment before firing, the barrel 141 and barrel extension 150 are released forward. The bolt group 108 also moves forward along the barrel extension 150 and lugs 138 on the bolt 130 lock with corresponding features in the distal end of the barrel extension 150 to chamber and fire a round. In some embodiments, the barrel group 108 is still moving forward when the chambered round is fired. In some such embodiments, a significant portion of the firing impulse is used to stop the forward momentum of the barrel group 108 and the remainder of the impulse (or a portion thereof) is absorbed by the recoil assembly 299.

In other embodiments, forward movement of the barrel assembly 140 stops when it contacts the battery lug 176 just prior to a round being fired. For example, the battery lug 176 on the receiver 168 makes contact with the barrel extension 150 as it moves forward from the recoil position. The battery lug 176 acts as a stop to define the forwardmost position of the barrel 141 and barrel extension 150. The battery lug 176 could similarly make contact with the barrel 141 or barrel lock 145, as will be appreciated. For example, the barrel extension 150 can move forward until a protrusion on the barrel 141, barrel lock 145, or barrel extension 150 (e.g., protrusion 181 shown in FIG. 5) engages the battery lug 176. In one embodiment, a surface **176*a* on the battery lug 176 (shown in FIG. 10) and a corresponding surface on the barrel extension 150 are angled to bias the barrel extension 150** to return to the same initial location.

The bolt actuator 110 is coupled to the op-rod 320 by an op-rod arm or connector 111 attached to and extending between the op-rod 320 and the transverse slot 135 of the bolt actuator 110. Upon firing the rifle, the op-rod 320 is displaced rearwardly by pressurized gases actuating the gas piston 146. This rearward motion of the op-rod 320 drives the bolt actuator 110 and bolt 130 rearward along the inside of the barrel extension 150. As the bolt 130 and bolt actuator 110 are displaced rearwardly, a protrusion 123 on the bolt actuator 110 guides the bolt actuator 123 along the barrel extension 150, in accordance with some embodiments. The connector 111 travels along the bottom slot 156. The bottom slot 156 is closed at the proximal portion 151 of the barrel extension 150, defining a stop surface for the connector 111 to make contact with the barrel extension 150 during rearward travel. In doing so, rearward momentum of the bolt group 108 is transferred to the barrel assembly 140, moving it rearwardly. Rearward movement of the barrel assembly 140 in turn causes the protrusion 158 on the barrel extension 150 to engage the actuator 314 of the hydraulic buffer 302 and compresses the buffer spring 304, for example. Thus, recoil forces are countered and dissipated by a combination of forces that include compression of the buffer spring 304 acting on the barrel extension 104, compression of the op-rod spring 306 acting on the op-rod 320 and bolt group 108, and actuation of the hydraulic buffer 302 acting on the bolt actuator 110 and op-rod 320 to transfer hydraulic fluid from one chamber to another. In some embodiments, the buffer assembly 300 alternately or additionally acts on the barrel extension 150. To some extent, each of these counteractive forces act on other components to dissipate recoil forces and to cycle the action, as will be appreciated. At the rearward end of the recoil cycle, for example, the op-rod spring 306 acts on the op-rod 320 and bolt actuator 110 to return the op-rod 320, bolt actuator 110, and bolt 130 forward; the buffer spring 304 acts on the barrel extension 150 via the actuator 314 to move the barrel extension 150 and barrel 141 forward; and the hydraulic buffer 302 acts on the bolt actuator 110 and other components to move the bolt actuator 110 and bolt 130 forward.

The recoil cycle also cycles the feed assembly 199. The feed cam roller 112 on the bolt actuator 110 is received in a channel defined by a feed cam 210. In one embodiment, the feed cam 210 includes a rearward portion 212 and a forward portion 213. The rearward portion 212 is generally linear and aligned along the barrel extension 150. The forward portion 213 can be curved or angled laterally with respect to the rearward portion 212. The rearward portion 212 is pivotably attached to the receiver 168 and the forward portion 213 interfaces with a cam link 214 on the feed tray 200. When the bolt actuator 110 is in the rearward position, the forward portion 213 of the feed cam 210 is biased by a spring towards the left side of the feed tray 200. As the bolt actuator 110 moves forward in a linear path along the barrel extension 150, the curve or bend along the forward portion 213 causes the forward portion 213 to conform to the position of the feed cam roller 112, causing the feed cam 210 to shift to the right. This movement of the feed cam 210 between the left and right positions causes the cam link 214 to be displaced upward from its downwardly biased position.

As the bolt actuator 110 moves forward, the bolt 130 is also moved forward with the rammer 136 passing through a slot in the feed tray 200 to strip a cartridge from a belt clip or other structure and push the cartridge forward and down into the chamber. When the bolt 130 reaches the battery position and chambers the cartridge, the bolt actuator 110 continues to move forward and rotates the bolt 130 due to the cam pin 122 following the helical slot 120. The continued forward motion of the bolt actuator 110 causes the firing pin 116 to impact the cartridge and fire the round. During this process, the feed assembly 199 pushes another cartridge 20 laterally across the feed tray 200 to position the cartridge 20 for feeding to the chamber.

Figure 9:
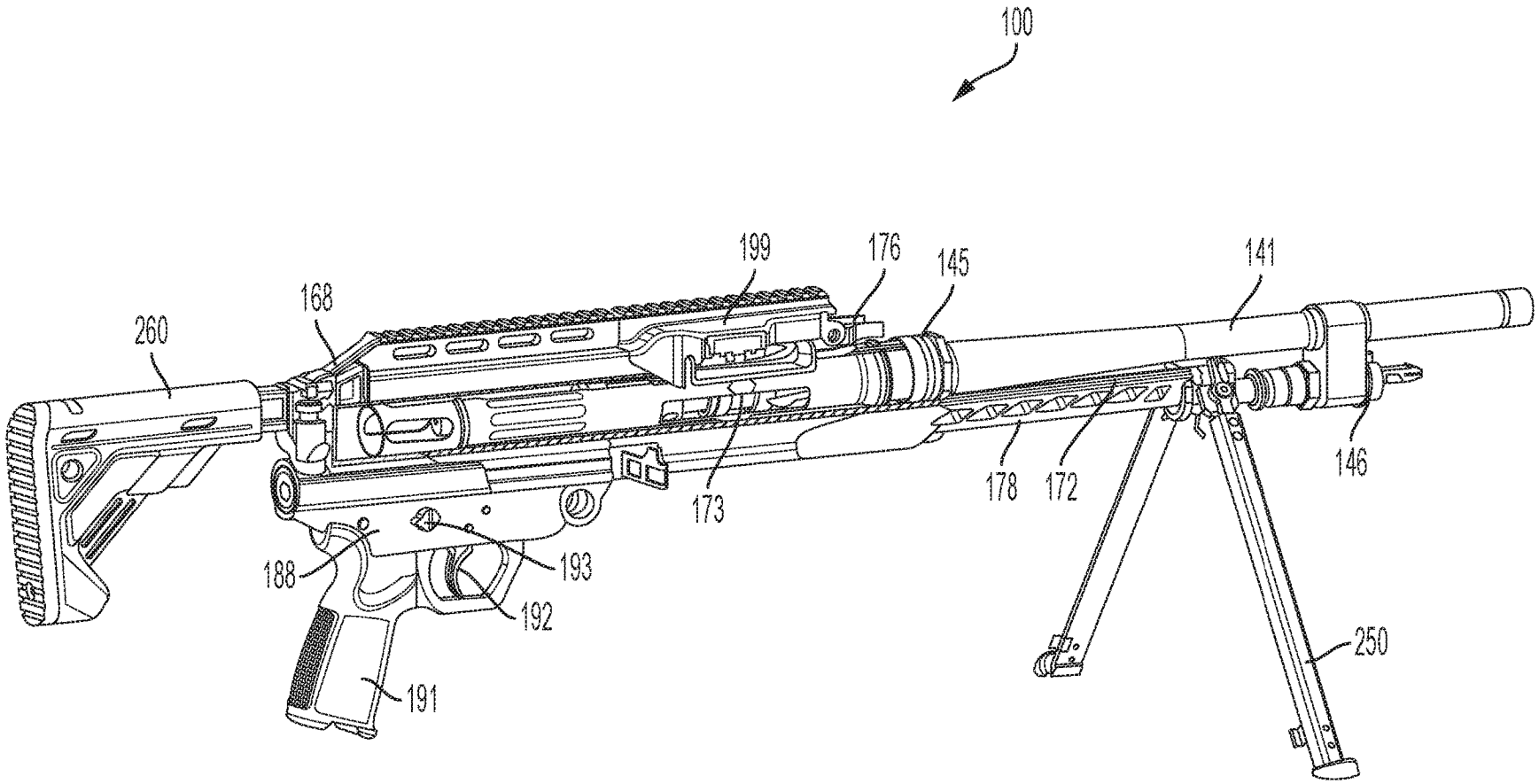
FIG. 9 is a perspective view showing the right and rear sides of a rifle with an internal soft-mounted recoil assembly with hydraulic buffer, an open-bolt feeding assembly, a gas piston assembly, and a folding stock, in accordance with an embodiment of the present disclosure.

Referring now to FIG. 9, a semi-transparent perspective view illustrates the right side of rifle 100, in accordance with an embodiment of the present disclosure. The receiver 168 is assembled with the trigger housing 188 and the feeding assembly 199 is connected to the open top of the receiver middle portion 173. The trigger housing 188 includes a grip 191 attached thereto and houses components of the fire control group 193, including the trigger 192, as will be appreciated. An adjustable and foldable stock 260 is attached to a rear or proximal end portion 194 of the trigger housing 188. The barrel lock 145 is positioned distally of the battery lug 176. The gas piston assembly 146 is attached to the barrel 141 with the piston 147 received in the guide tube 178 on the distal receiver portion 12. A bipod 250 is pivotably attached to the distal end of the distal receiver portion 172 and folded to the open position.

Figure 10:
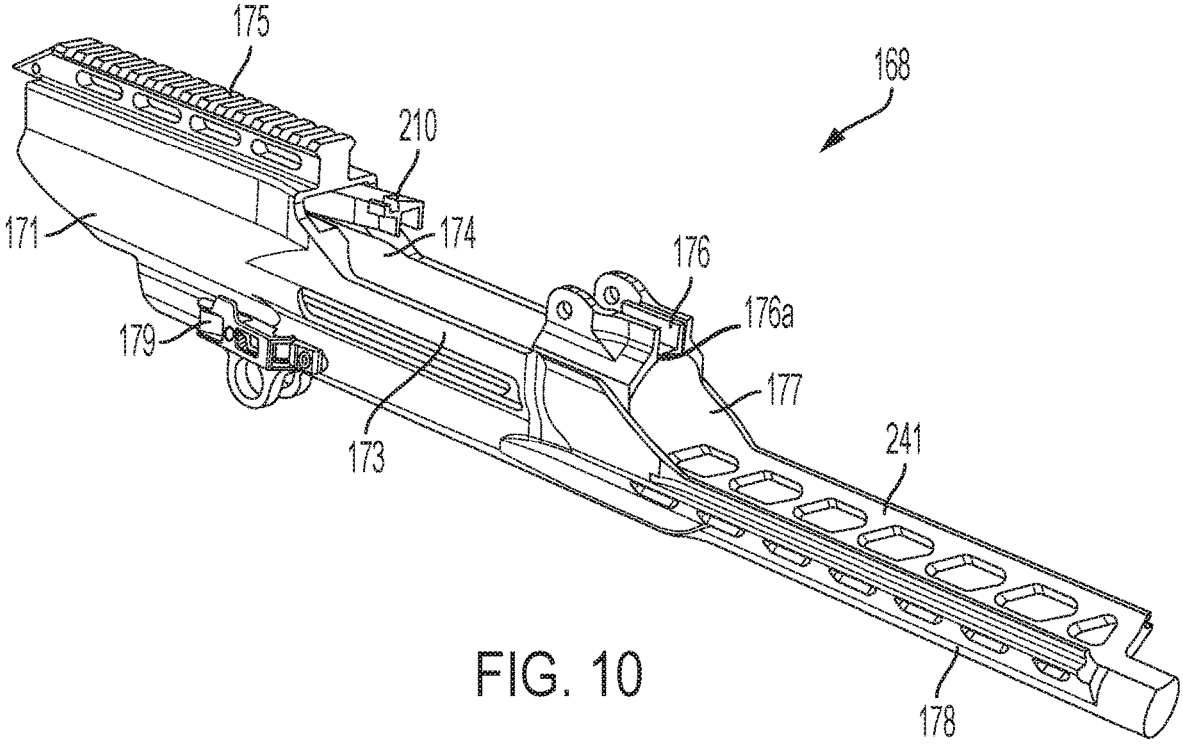
FIG. 10 is a perspective view showing the top, right, and front sides of a receiver for a machine gun, in accordance with an embodiment of the present disclosure.

Referring now to FIG. 10, a perspective view illustrates the top, right, and front sides of a receiver 168, in accordance with an embodiment of the present disclosure. The receiver 168 extends longitudinally and includes a proximal receiver portion 171, a distal receiver portion 173, and a middle receiver portion 173. The receiver 168 is constructed to mate with and attach to the trigger housing 188 (shown in FIG. 11). The receiver 168 defines a barrel extension opening 174 that extends through the receiver 168. The barrel extension opening 174 is sized and configured to receive the barrel extension 150. The barrel extension opening 174 defines a barrel opening 177 adjacent the distal receiver portion 172 where the barrel lock 145 is positioned when the rifle 100 is assembled. The distal receiver portion 172 includes a handguard lower portion 241 and a guide tube 178 for the op-rod 320. The op-rod 320 is partially housed in the guide tube 178 and is arranged to be actuated by the gas piston 147 upon firing the rifle. For example, upon firing the rifle, pressurized gases in the barrel displace the gas piston 147 to drive the op-rod 320 proximally against forces of the op-rod spring 306. Optionally, a rail 175 extends along a top surface of the receiver 168. The feed cam 210 is connected to an inside of the proximal receiver portion 171 and extends proximally over the middle receiver portion 173. The middle receiver portion 173 has an open top along the chamber where the feed assembly 199 can be installed and includes the battery lug 176. A charger 179 is attached along the bottom, right portion of the receiver 168.

Figure 11:
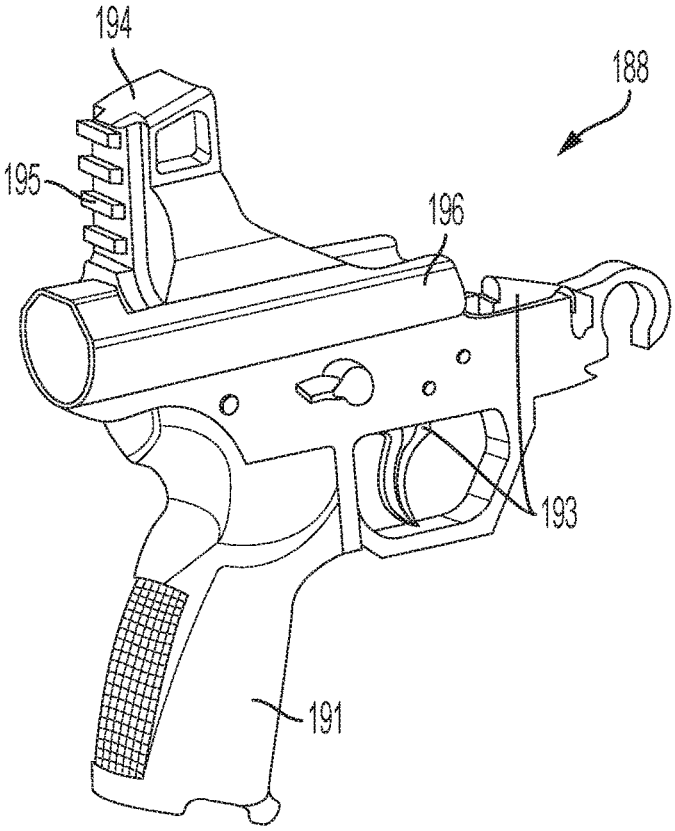
FIG. 11 is a perspective showing the right and rear sides of a trigger housing configured to assemble with the receiver of FIG. 10, in accordance with an embodiment of the present disclosure.

Referring now to FIG. 11, a perspective view shows a right and rear sides of a trigger housing 188 configured to attach to the receiver 168 of FIG. 10, in accordance with an embodiment. As shown here, the trigger housing 188 includes an attached grip 191 and components of the fire control group 193, as will be appreciated. A proximal end portion 194 is configured to extend upward along the corresponding portion of the receiver 168 and optionally includes a rail 195 for attachment of the stock 260, such as shown in FIGS. 1-2. The trigger housing 188 defines a tube 196 configured to retain the hydraulic buffer 302 (not shown) or like components. The tube 196 is positioned vertically below the bore axis when the trigger housing 188 is assembled with the receiver 168, in accordance with some embodiments.

Figure 12:
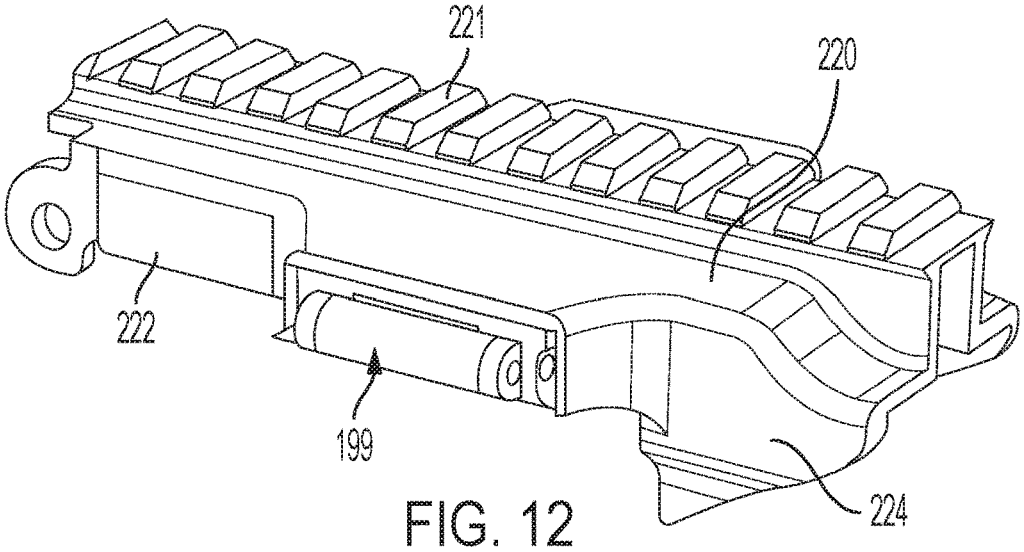
FIG. 12 is a perspective view showing the top, left, and rear sides of a feed cover that includes a portion of the top rail and portions of the feeding assembly, in accordance with an embodiment of the present disclosure.
Figure 13:
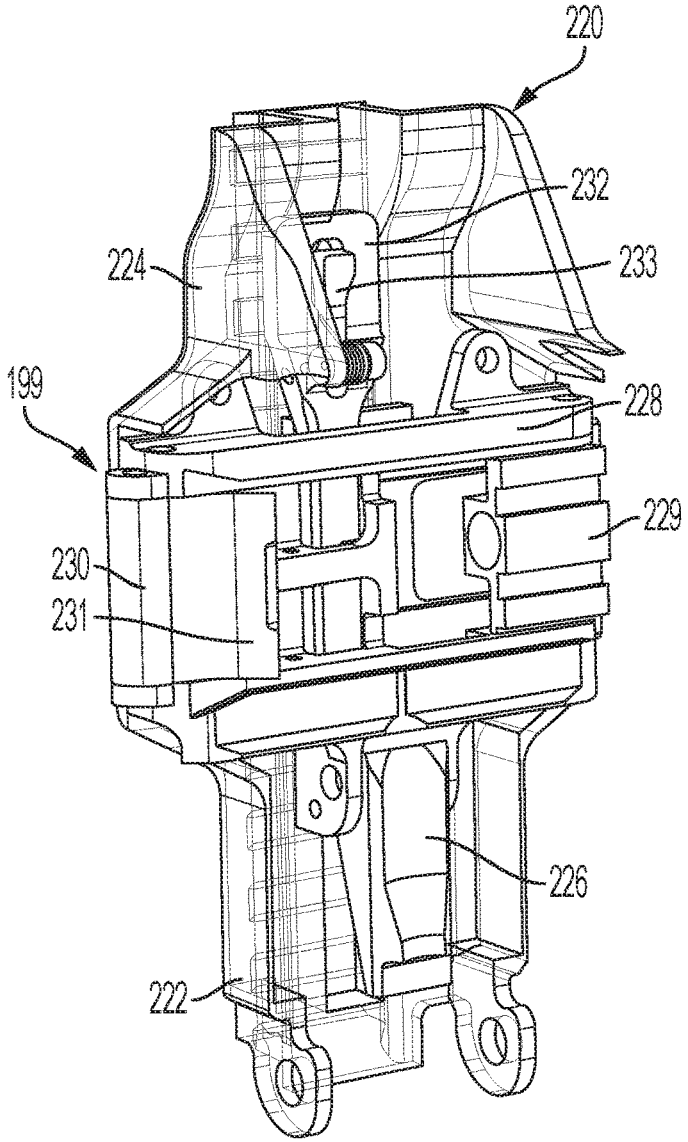
FIG. 13 is a bottom view of the feed cover of FIG. 12 showing portions of the feeding assembly with a feed pawl, slide, and slide return, cam feed link, and feed guide, in accordance with an embodiment of the present disclosure.

Referring now to FIGS. 12 and 13, perspective views show a feed cover 220 along with components of the feed assembly 199, in accordance with an embodiment of the present disclosure. FIG. 12 illustrates the left and rear sides of the feed cover 220 and FIG. 13 shows a bottom side of the feed cover 220. In one embodiment, the feed cover 220 includes a rail 221 that aligns in continuity with the rail 175 along the top of the receiver 168. For example, the rails 221, 175 are Picatinny rail (i.e., MIL-1913 Rail) or other suitable mounting rail system, as will be appreciated. A distal cover portion 222 is constructed to be hingedly attached to the receiver 168 adjacent the battery lug 176. The feed cover 220 widens moving towards a proximal cover portion 224 to accommodate components of the feeding assembly 199, which is configured as a left-side feed in some embodiments.

Referring to FIG. 13, a bottom portion of the feed cover 220 and feeding assembly 199 are shown. The distal cover portion 222 includes a feed guide 226 that is shaped to direct a cartridge to battery as the action cycles. The feeding mechanism 199 includes a slide housing 228 with a slide return 229 and a slide 230 with a feed pawl 231. A return spring (not shown) housed in the slide return 229 biases the slide 230 towards the left (for left-hand feed). As a cartridge is moved into the strip position, the slide 230 moves over top of the round and the feed pawl 231 occupies the gap between adjacent cartridges to maintain placement of the cartridge in the strip position and prevent removal of clipped together cartridges from the rifle 100. A cam feed link 214 is biased downward and includes a tongue 233 shaped to occupy a cam link receptacle 215 (shown in FIG. 18) on the feed cam 210 when the feeding assembly 199 is in the charged position.

Figure 14:
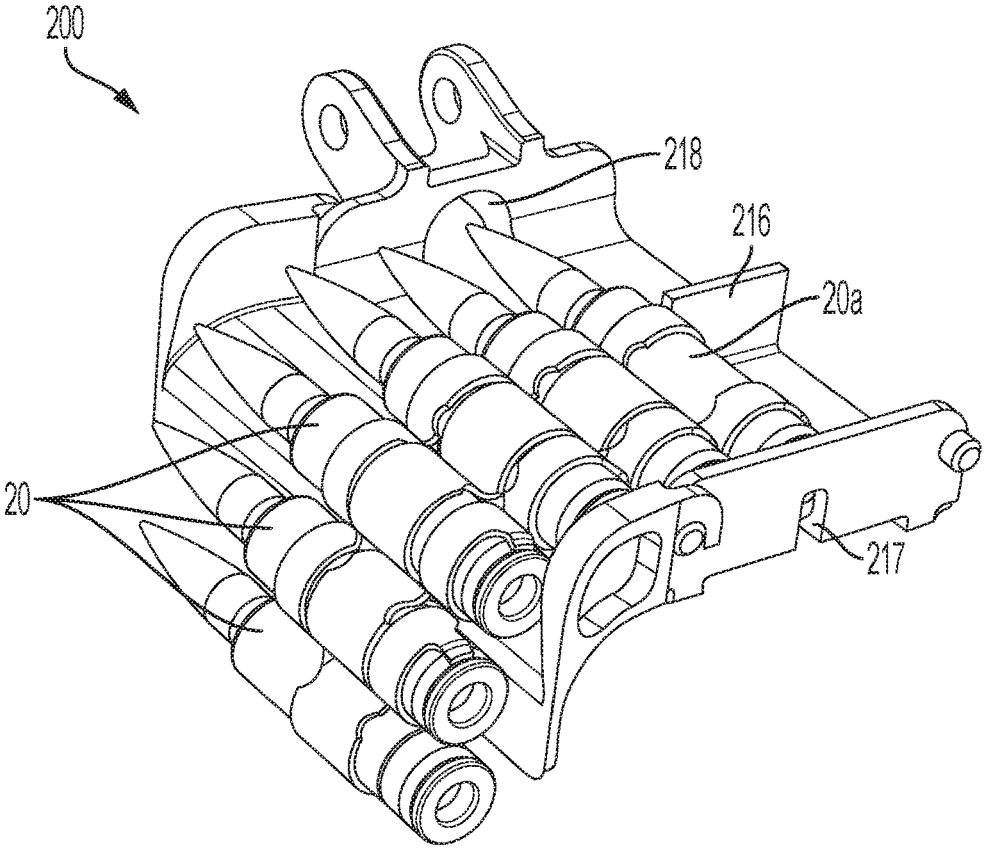
FIG. 14 is a perspective view showing the top, left, and rear sides of a feed tray with a plurality of cartridges assembled for belt feeding, where a leading cartridge is positioned to be stripped from the belt and chambered, in accordance with an embodiment of the present disclosure.

Referring now to FIGS. 14-19, the feeding assembly 199 and individual components are shown in various positions, in accordance with an embodiment of the present disclosure. FIG. 14 illustrates a perspective view showing the top, rear, and left sides of a feed tray 200. The feed tray 200 is shown with a plurality of cartridges 20 clipped together as in a belt-feed configuration. The leading cartridge **20*a* is in the stripping position and disposed against a stop block 216 with the projectile aligned to enter a feed guide entrance 218 of the feed guide 226 (shown in FIG. 13). In this example, the stop block 216 is a wall or partition that extends upward from the bottom plate 202 of the feed tray 200 and extends perpendicularly to the bore axis. The stop block 216 could alternately be a post, block, or other structure suitable to define a stop for the leading cartridge 20***a*. The rammer opening 217 is a slot-like opening in the bottom plate 202 and proximal wall of the feed tray 200. The rammer opening 217 is aligned with the head of the leading cartridge 20*a* and is configured to enable the rammer 136 to engage the leading cartridge 20*a* when the bolt 130 advances forward to the battery position.

Figure 15:
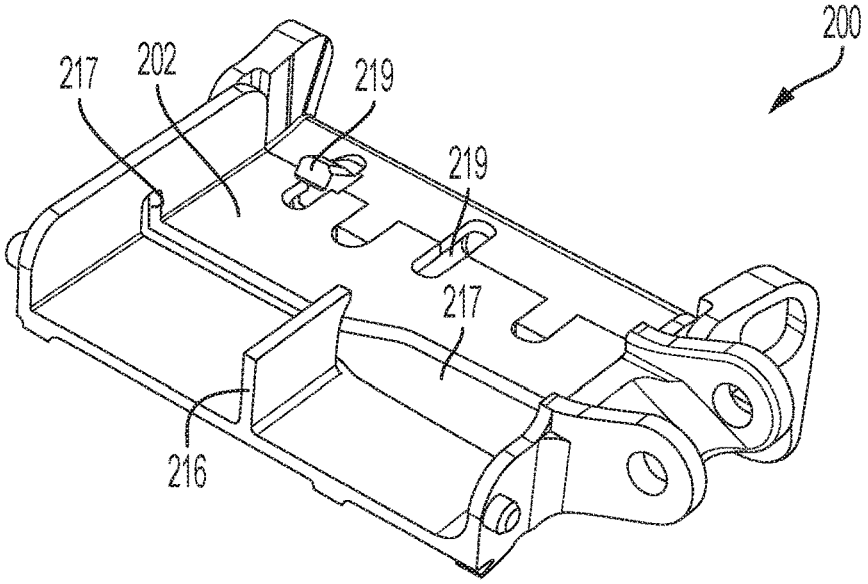
FIG. 15 is a perspective view showing the top, right, and front sides of the feed tray of FIG. 14, showing pawls and a ramming slot, in accordance with an embodiment of the present disclosure.

FIG. 15 illustrates a perspective view showing the front and right sides of the feed tray 200 of FIG. 14. One or more pawls 219 are pivotably mounted to extend up through the feed tray 200 to prevent backwards feeding motion of the cartridges 20. For example, as cartridges 20 feed towards the stripping position (e.g., left to right) the pawl(s) 219 move against spring force into the bottom plate 202 of the feed tray, and then spring upward between cartridges 20 to prevent movement of the cartridges in a reverse direction. The rammer opening 217 is located laterally between the pawls 219 and the stop block 216 in some embodiments. In some embodiments, the rammer opening 217 widens towards the distal end portion of the feed tray 200 to permit a cartridge 20 to pass downward through the slot 204 as it passes into the feed guide entrance 218 (shown in FIG. 14).

Figure 16:
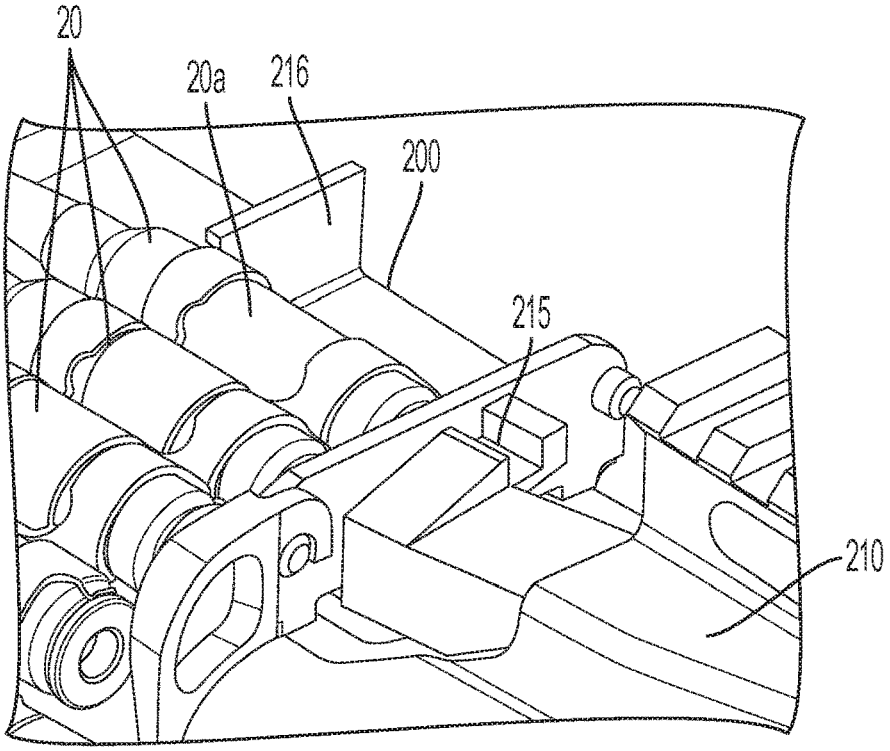
FIG. 16 is a perspective view showing the top, rear, and left side of part of the feed tray and feed cam, in accordance with an embodiment of the present disclosure.

FIG. 16 is a perspective view showing the top, left, and rear sides of the feed tray 200 and cam link receptacle 215, in accordance with an embodiment. Cartridges 20 are shown clipped together in a belt configuration with a leading cartridge 20*a* abutting the stop block 216 on the feed tray 200. The leading cartridge 20*a* is in the strip position and aligned with a rammer opening 217 on the feed tray 200.

Figure 17:
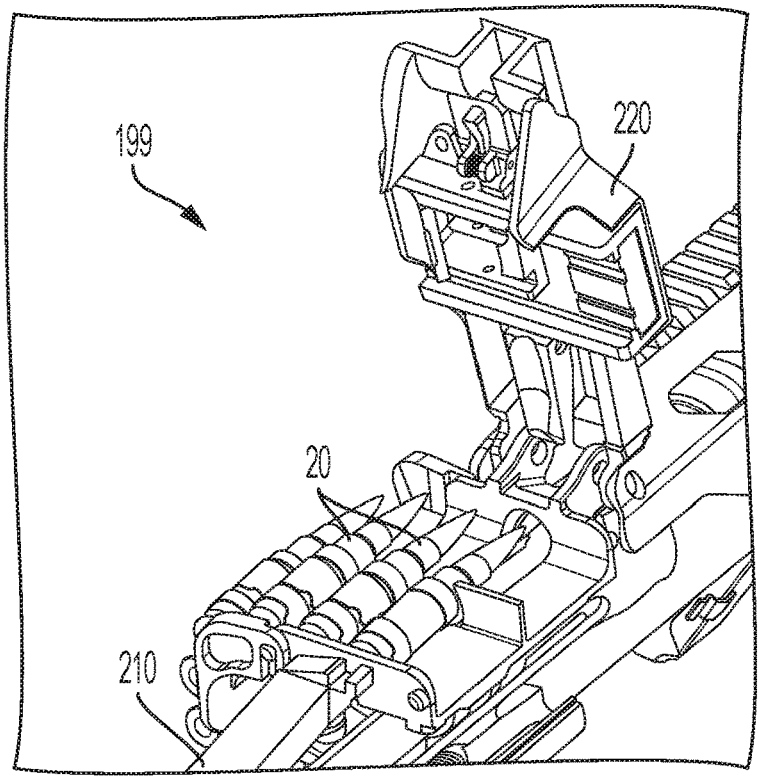
FIG. 17 is a perspective view showing the top, rear, and right sides of a feeding assembly with the feed cover in an open position and the feed cam in a battery position, in accordance with an embodiment of the present disclosure.
Figure 18:
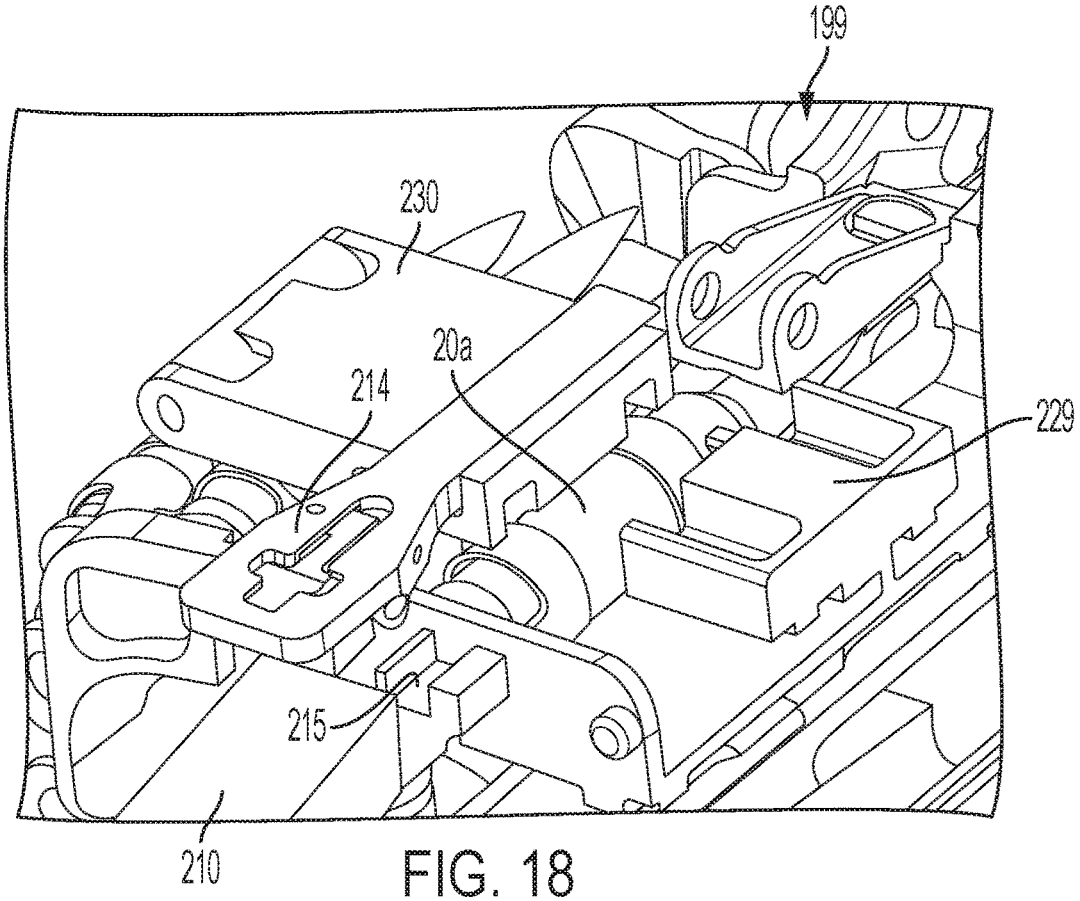
FIG. 18 is a perspective view showing the top, right, and rear sides of a feeding assembly with the feed cam in a battery position, in accordance with an embodiment of the present disclosure.
Figure 19:
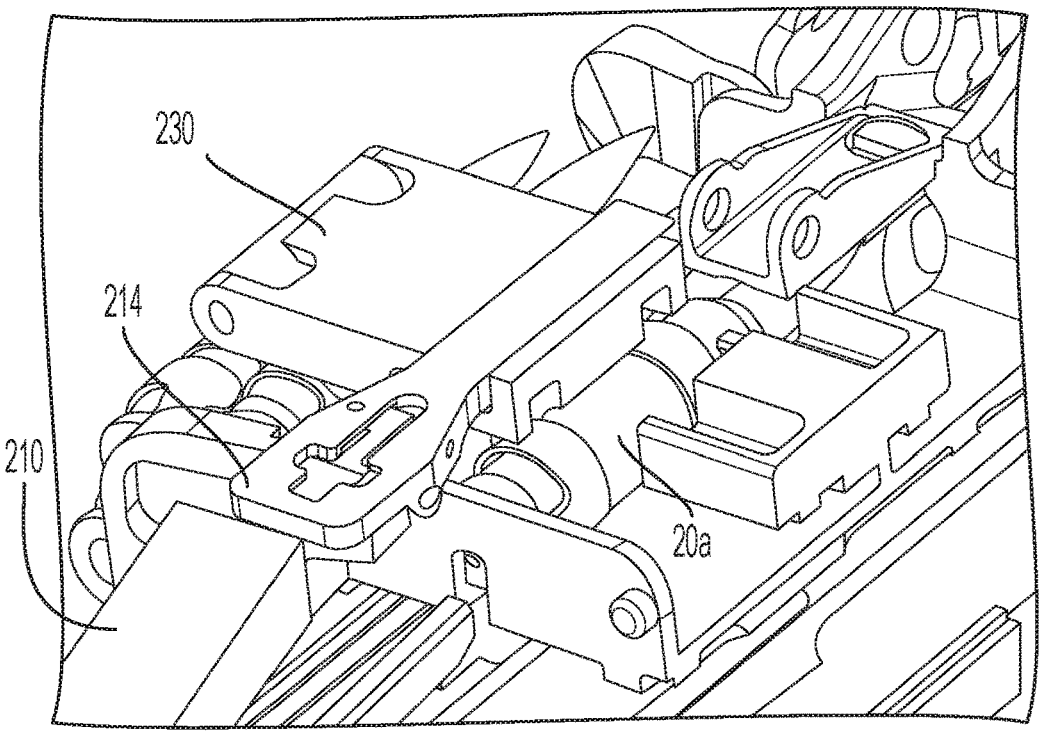
FIG. 19 is a perspective view showing the top, right, and rear sides of the feeding assembly of FIG. 18 with the feed cam in a recoil position, in accordance with an embodiment of the present disclosure.

FIG. 17 is a perspective view showing the top, right, and rear sides of the feeding assembly 199 with the feed cover 220 in an open position, in accordance with an embodiment. The forward portion 213 of the feed cam 210 is aligned behind the leading cartridge 20*a* due to the bolt actuator 110 being in the forward position (e.g., battery position). In FIG. 18 the cover has been closed (cover omitted for clarity to show the slide 230). The slide 230 is biased left by the slide return 229 and the cam link 214 is misaligned with the cam link receptacle 215 and offset from the feed cam 210. When the charger 179 is operated to place the bolt 130 and bolt actuator 110 in the charged position, the feed cam 210 shifts left as shown in FIG. 19. As the feed cam 210 shifts left, a ramp on the distal end of the feed cam 210 engages the tongue 233 of the cam feed link 232, displacing the cam feed link upward until the feed cam moves sufficiently to the left for the tongue 233 to drop into the cam link receptacle 215. When the bolt actuator 110 moves forward, it pushes the leading cartridge 20*a* to battery and shifts the feed cam 210 to the right, thereby causing the feed pawl 231 to move the next cartridge 20 to the strip position.

Figure 20:
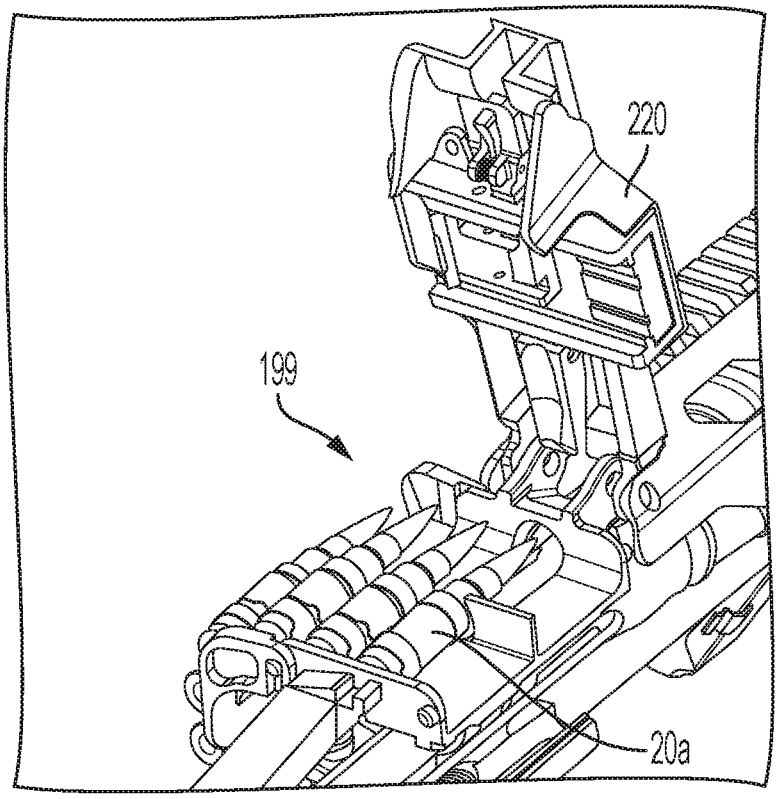
FIG. 20 is a perspective view showing the top, right, and rear sides of a feeding assembly with the feed cover in an open position and the feed cam in a recoil position, in accordance with an embodiment of the present disclosure.
Figure 21:
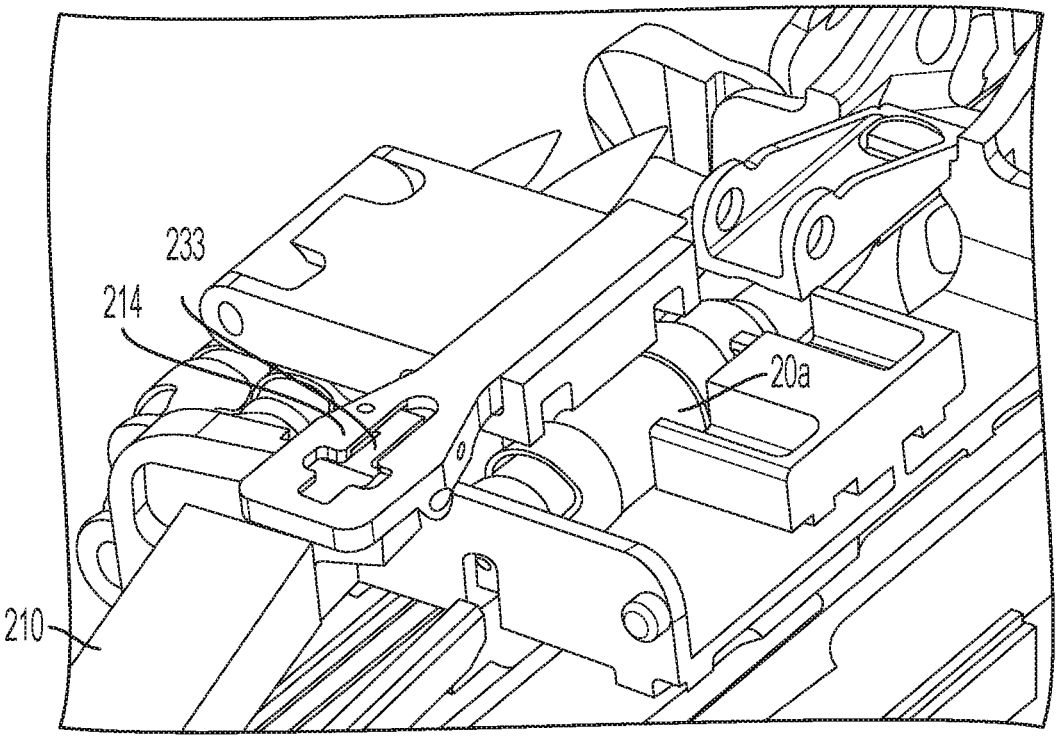
FIG. 21 is a close-up perspective view showing the top, right, and rear sides of a feeding assembly with the feed cam in a recoil position, in accordance with an embodiment of the present disclosure.

FIG. 20 is a perspective view showing top, right, and rear sides of the feeding assembly 199 in a charged position, in accordance with an embodiment of the present disclosure. Here, the feed cover 220 is open, and the leading cartridge 20*a* loaded into the strip position. In FIG. 21, the feed cover 220 has been closed (feed cover 220 omitted for clarity), causing the cam feed link 232 to engage the cam link receptacle 215 in the feed cam 210.

Figure 22:
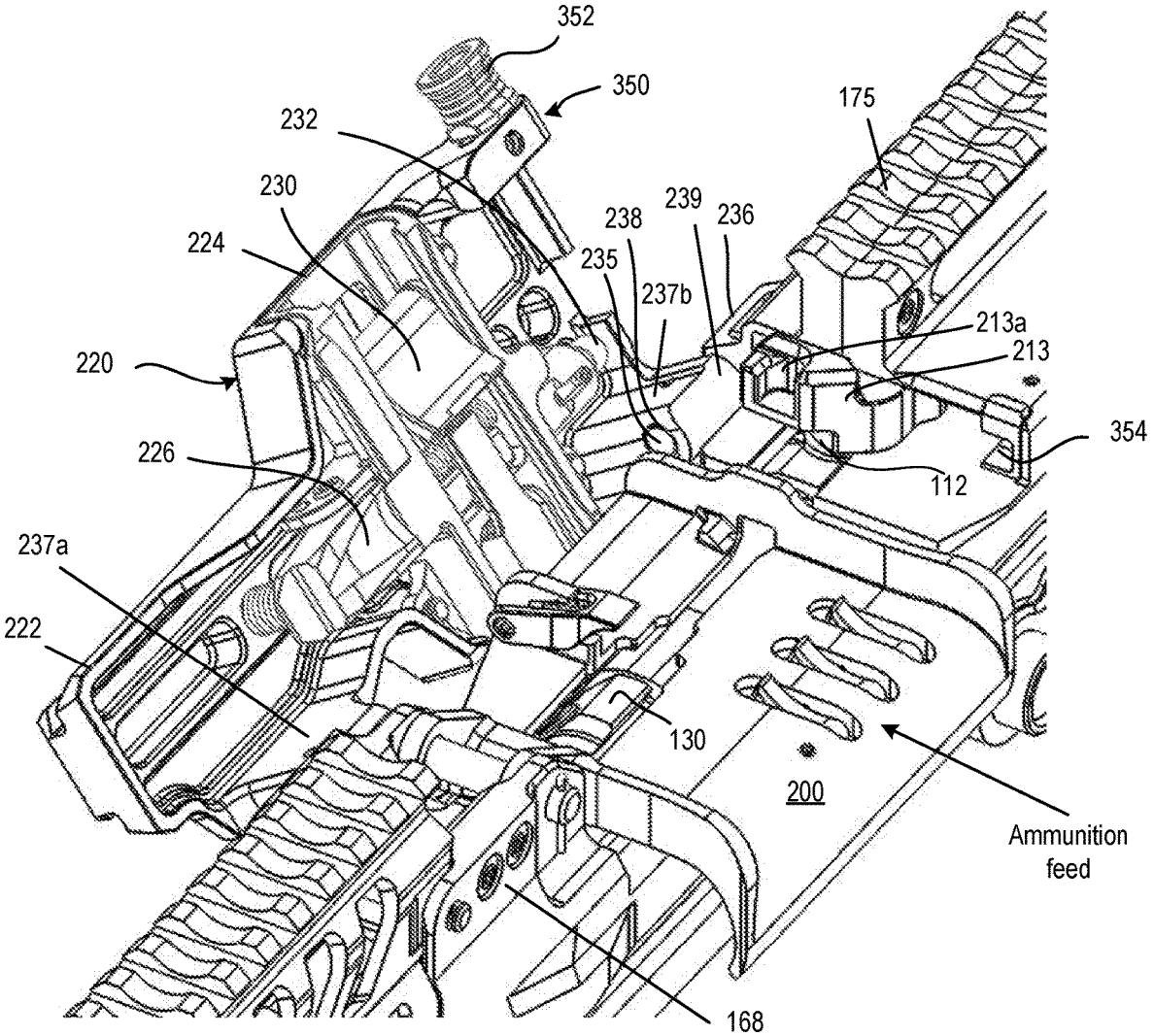
FIG. 22 is a perspective view showing a portion of the top, left, and front sides of a rifle receiver with a feed cover in an open position, in accordance with another embodiment of the present disclosure.
Figure 23:
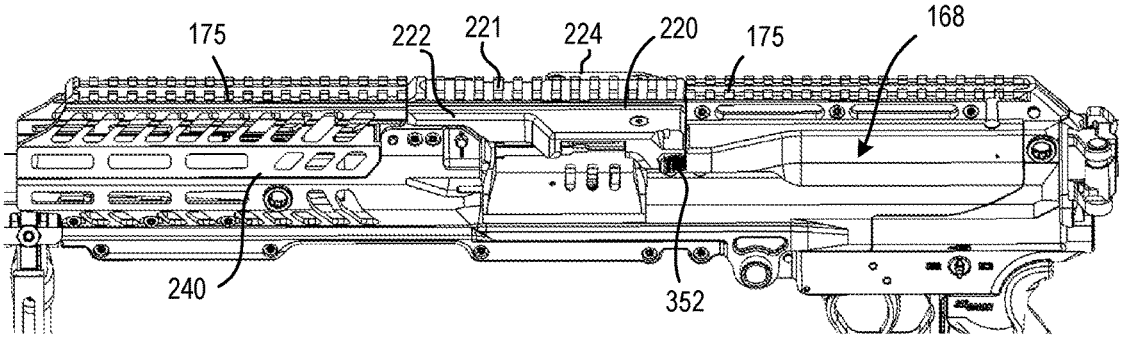
FIG. 23 is a side view showing the top and left side of the receiver and feed cover of FIG. 22 with the feed cover in a closed position, in accordance with an embodiment of the present disclosure.
Figure 24:
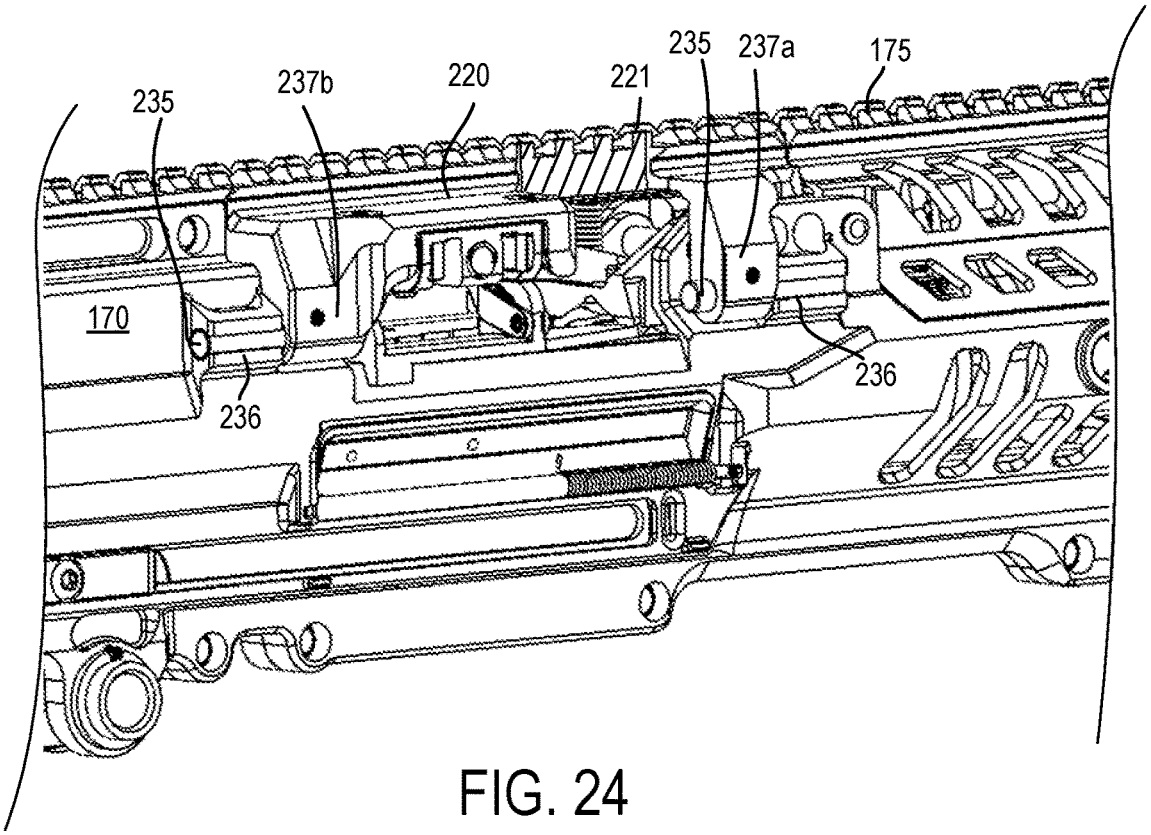
FIG. 24 is a perspective view showing part of the right side of the receiver with the feed cover in a closed position, in accordance with an embodiment of the present disclosure.
Figure 25:
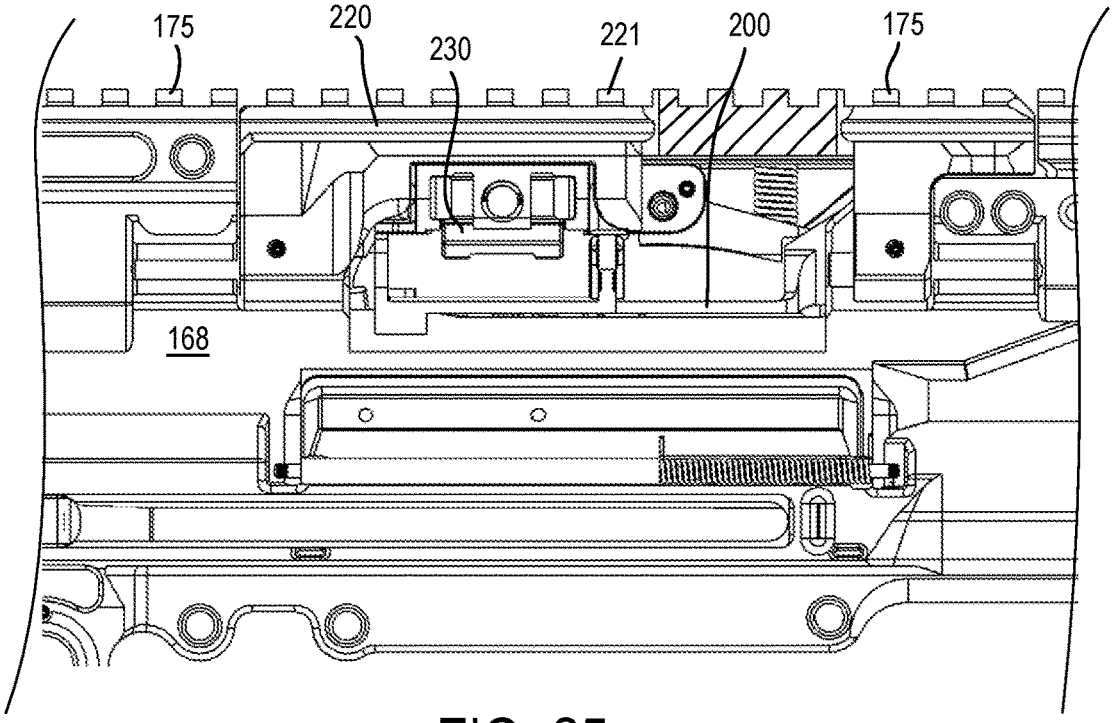
FIG. 25 is a side view showing part of the right side of the receiver of FIG. 24 with the feed cover 220 in a closed position.
Figure 26:
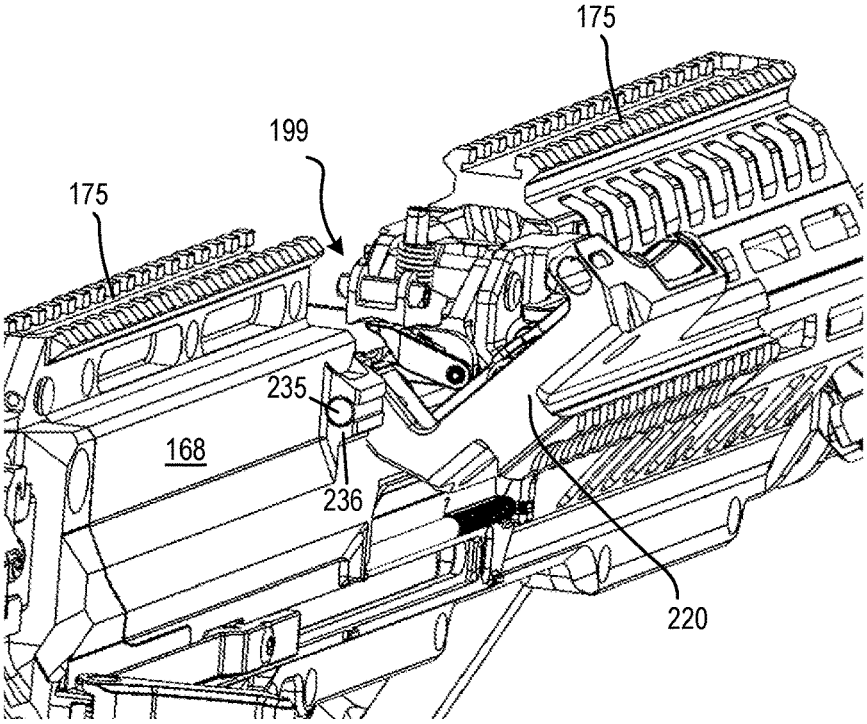
FIG. 26 is a rear perspective view showing the right side and rear sides of the receiver with the feed cover in an open position, in accordance with an embodiment of the present disclosure.
Figure 27:
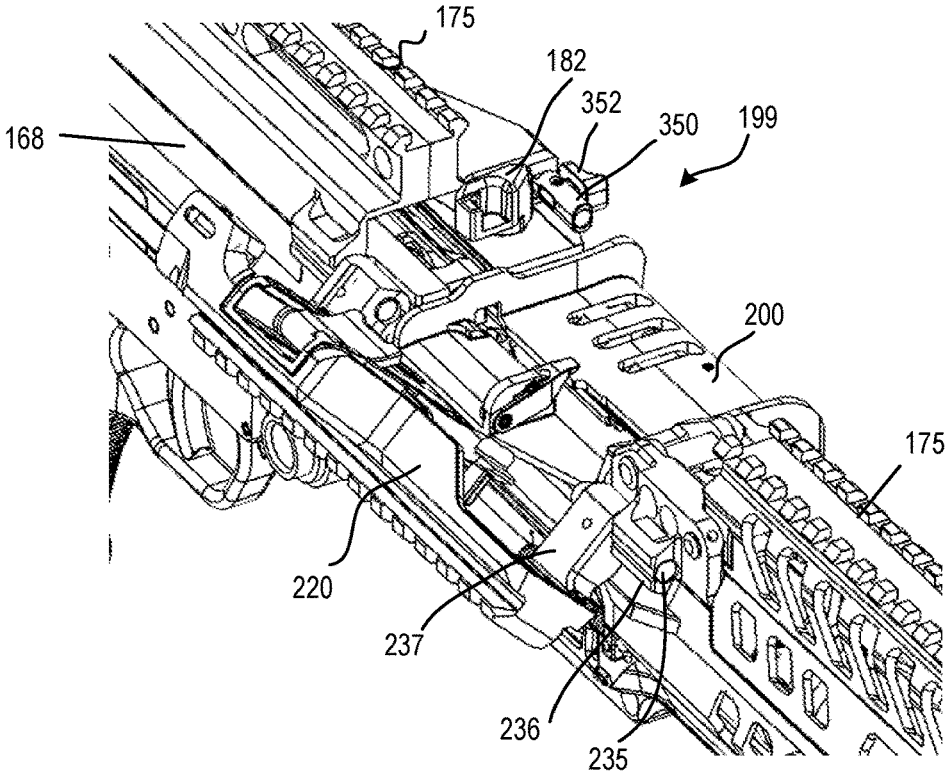
FIG. 27 is a top perspective view showing the top, front, and right sides of the receiver with the feed cover in an open position, in accordance with an embodiment of the present disclosure.
Figure 28:
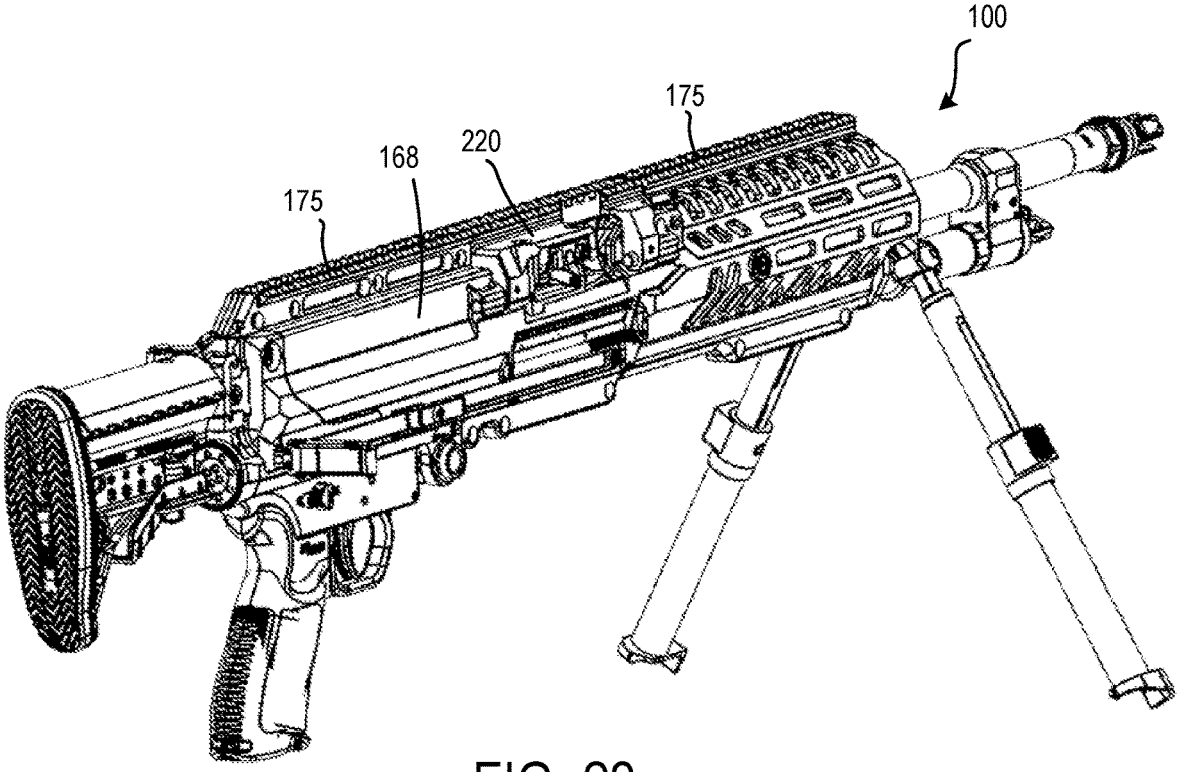
FIG. 28 is a rear perspective view showing a rifle with the feed cover of FIG. 22 in a closed position, in accordance with an embodiment of the present disclosure.
Figure 29:
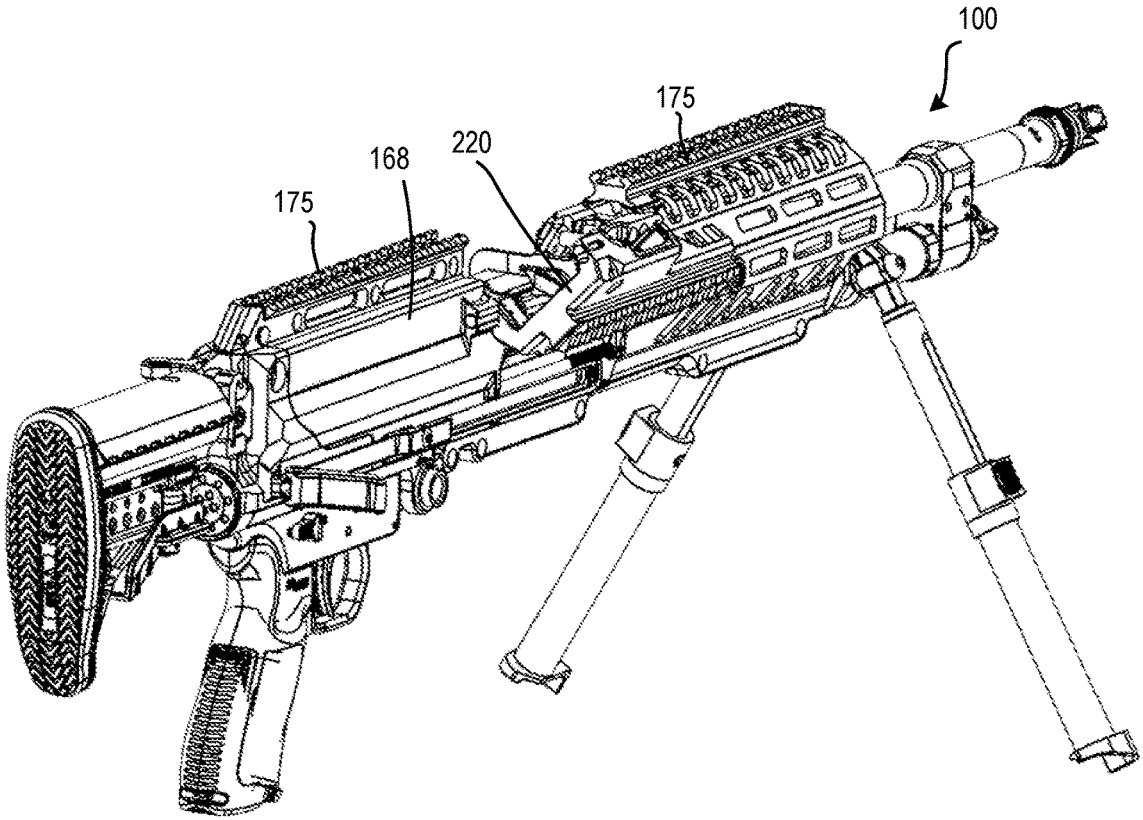
FIG. 29 is a rear perspective view showing a rifle with the feed cover of FIG. 22 in an open position, in accordance with an embodiment of the present disclosure

Referring now to FIGS. 22-29, various views illustrate a feed cover 220 that is hingedly attached and opens to a side of a rifle receiver 168, in accordance with an embodiment of the present disclosure. FIG. 22 is a perspective view showing a portion of the top, left, and front sides of a rifle receiver 168 with the feed cover 220 in an open position to the right side of the rifle; FIG. 23 is a side view showing the top and left side of the receiver 168 with the feed cover 220 in a closed position; FIGS. 24 and 25 are perspective and side views showing part of the right side of the receiver 168 with the feed cover 220 in a closed position; FIG. 26 is a rear perspective view showing the right side and rear sides of the receiver 168 with the feed cover 220 in an open position; FIG. 27 is a top perspective view showing the top, front, and right sides of the receiver 168 with the feed cover 220 in an open position; FIGS. 28 and 29 are rear perspective views showing a rifle with the feed cover 220 in closed and open positions, respectively. FIGS. 22-29 will be discussed concurrently below.

In this embodiment, the feed cover 220 is hingedly attached to the receiver 168 such that the feed cover 220 can pivot or fold open to one side of the receiver 168 rather than folding about a hinge extending laterally across the upper receiver 170, such as shown in FIG. 2. One advantage of the side-folding feed cover 220 is that the rifle 100 has a continuous, segmented rail 175, 221 along the top of the rifle 100. As discussed above, the rails 221, 175 can be any suitable mounting rail system, as will be appreciated. The rail 221 on the feed cover 220 can be used, for example, to mount a reflex sight or other accessory. Also, an optic or other accessory can be mounted to the rail 175 distally of the feed cover 220 without interfering with the feed cover 220 when it opens, and vice versa. In one example, a rifle scope or the like can be mounted on the rail 175 distally of the feed cover 220 with part of the rifle scope overlapping the narrower distal portion 222 of the feed cover 220. In the embodiment of FIGS. 22-29, the feed cover 220 can be opened to the side without interfering with the rifle scope provided that there is sufficient clearance between the rifle scope and the rail 175 for the distal portion 222, as will be appreciated.

Compared to other designs, the feed cover 220 in its closed position has increased stability and the rail 221 on top of the feed cover 220 has more precise alignment with the rail 175 on top of the upper receiver 170. In accordance with one embodiment, the feed cover 220 is secured to the upper receiver 170 at three or more points, including the spaced apart front and rear hinge pins 235 on one side of the cover and the latch 350 on the opposite side of the upper receiver 170. Further, the feed cover 220 may engage the receiver 168 in one or more points for additional stability, such as behind the feed tray 200. As such, the side-folding feed cover 220 can consistently return to a closed position in which the rail 221 on the feed cover 220 is aligned with the rail 175 on the receiver 168 for reliable alignment of optics or other accessories.

Similar to embodiments discussed above with reference to FIG. 13, the feed cover 220 includes some components of the feed assembly 199, such as the feed guide 226, slide 230, cam link 232, and related components. As shown in FIG. 22, the distal end 213 of the feed cam 210 (shown in FIG. 8) extends from the receiver 168 to operationally engage the cam link 232 retained on the bottom face of the feed cover 220. Since the cam link 232 engages the feed cam 210, rather than being constructed as a single component therewith, the axial length of the feed cover 220 can be reduced to the general region of the feed tray 200. The reduced length of the feed cover 220 enables improved use of the fixed rail 175 along proximal portions of the receiver 168, among other advantages. When the feed cover 220 is closed, the cam link 232 may be positioned to the left side of the feed tray 200 and out of engagement with the feed cam 210. Charging the action causes the cam link 232 to travel along the rounded outer surface of the distal portion 213 of the feed cam 210 and then seat into the notch or recess 213*a*. For example, the cam link 232 is deflected distally as it travels along the distal portion 213 of the feed cam 210, and then when it is aligned with the recess 213*a*, it moves proximally due to spring bias to seat in the recess 213*a*. During operation of the rifle 100, the cam link 232 remains engaged with the cam link 210 and reciprocates laterally as the action cycles. The action of the rifle 100 is also discussed above with reference to FIG. 8.

In one example, the feed cover 220 can pivot about one or more hinge pins 235 that extend through part of the feed cover 220 and into corresponding receptacle(s) 236 on the receiver 168. For example, the receptacles 236 are located along a side of the receiver 168. The feed cover 220 has one or more hinge leaves 237 that extend transversely (e.g., perpendicularly) away from the bottom of the feed cover 220. The leaf 237 (or portions thereof) can be configured as a post, bracket, tongue, plate, or other structure that extends away from the bottom of the feed cover 220. Each hinge leaf 237 (or portions thereof) defines a pin opening 238 for a hinge pin 235 that extends generally parallel to the bore axis. For example, the leaf 237 is a plate that terminates with one or more hinge knuckles that define the pin opening 238 therethrough. In another example, the feed cover 220 has a plurality of hinge leaves 237 that are constructed as blocks or posts extending away from the bottom of the feed cover 220, where each hinge leaf 237 defines a pin opening 238 sized for hinge pin 235. In its assembled state, the hinge pin 235 extends through each pin opening 238 to hingedly attach the feed cover 220 to the receiver 168. In some embodiments, a single pin 235 is used that extends through a pin opening 238 on the hinge leaf 235 (or leaves 235). In other embodiments, the feed cover 220 has a separate pin 235 for each pin opening 238.

As shown in this example embodiment, the feed cover 220 has a front hinge leaf 237*a* and a rear hinge leaf 237*b* located along the right side of the feed cover 220 so that the feed cover 220 can pivot open to the right side of the receiver 168. In other embodiments, the feed cover 220 can include more or fewer hinge leaves 237, each of which operates with a common or distinct hinge pin 235. The open position being on the right side of the rifle 100 is well suited for a feed assembly 199 that feeds ammunition from the left side of the rifle 100, as will be appreciated. In other embodiments, each hinge leaf 237 or hinge leaf portion can be on the left side of the receiver 168 to enable opening the feed cover 220 to the left side of the rifle 100, such as for use with a feed assembly 199 that feeds ammunition from the right side. Optionally, the end 239 (e.g., hinge knuckle) of the hinge leaf 237 or leaf portions can be rounded to rotationally interface with a corresponding surface on the receiver 168. For example, the end 239 of each leaf 237 has a convexly curved shape that pivots along a corresponding concavely curved surface on the receiver 168 when the feed cover 220 moves between the open and closed positions.

A latch 350 on the left side (or side opposite the hinge leaf 237) of the feed cover 220 is configured to engage a latch recess 354 on the receiver 168 (or vice versa) when the feed cover 220 is in the closed position. To open the feed cover 220, the operator can release the latch 350 using the latch handle 352 or latch button 352.

Figure 30:
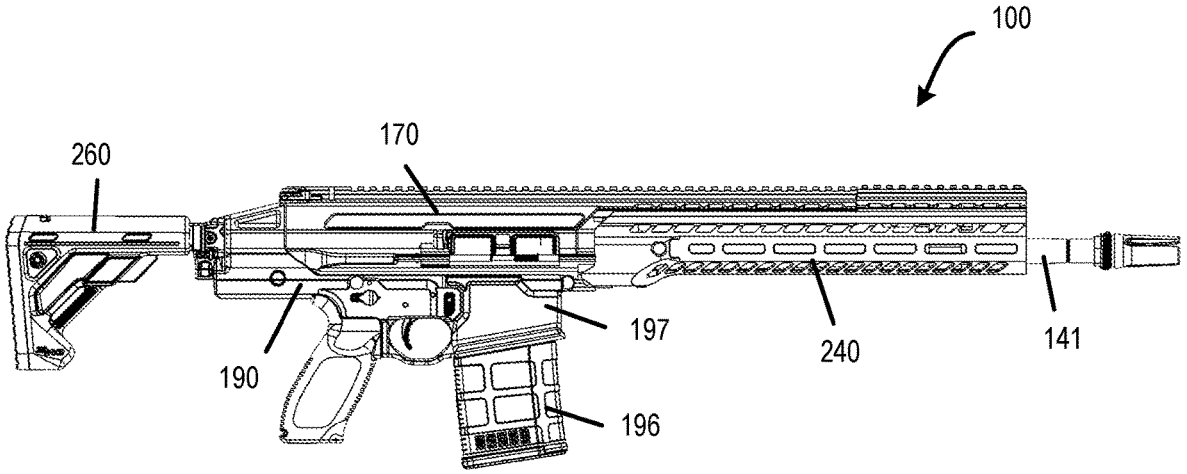
FIG. 30 illustrates the right side of a rifle configured with a fixed magazine and closed bolt system, in accordance with another embodiment of the present disclosure.
Figure 31:
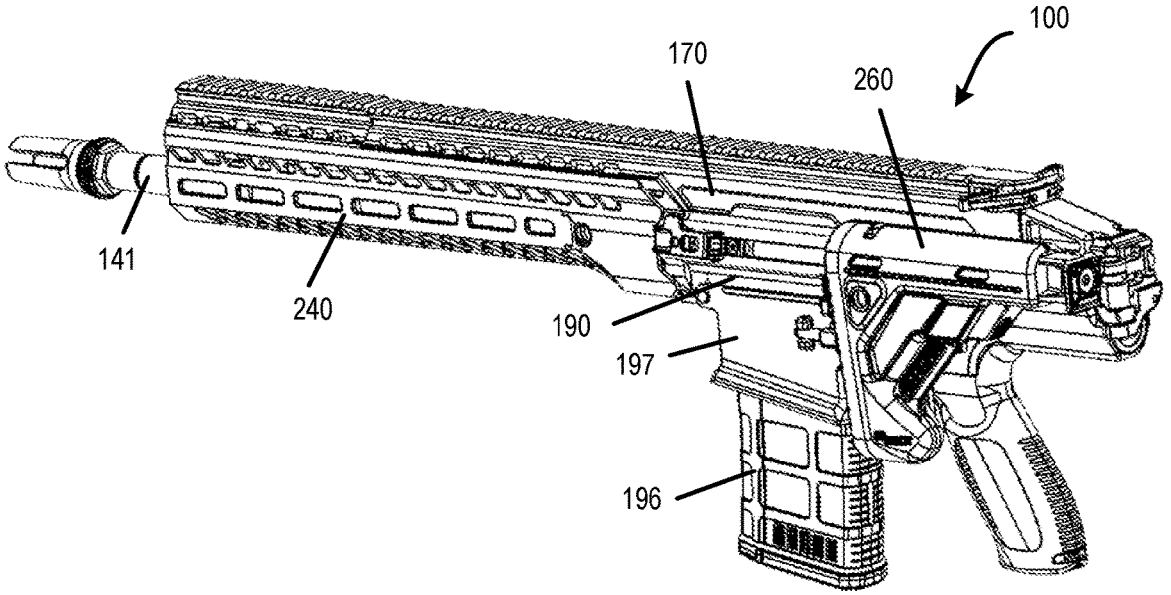
FIG. 31 is a perspective view showing the top, left, and rear sides of the rifle of FIG. 30, where the stock folded to a stowed position, in accordance with an embodiment of the present disclosure.

Referring now to FIGS. 30-31, a right-side view and right, rear perspective view show a rifle 100 with a closed bolt configuration and fixed magazine 196, in accordance with another embodiment of the present disclosure. Similar to embodiments discussed above, rifle 100 includes a lower receiver 190 and an upper receiver 170. A handguard 240 is attached to the upper receiver 170 and extends along the barrel 141. A foldable stock 260 is attached to a rear end of the lower receiver 190. In FIG. 30, the stock 260 is shown in a deployed position, and in FIG. 31, the stock 260 is shown in a folded position. In this embodiment, rifle 100 has a closed-bolt configuration and uses a detachable box magazine, consistent with rifles based on the AR-15 platform, as will be appreciated. Ammunition can be fed to the chamber from a fixed magazine 196 installed in a magazine well 197. Numerous configurations and variations will be apparent in light of the present disclosure.

Figure 32:
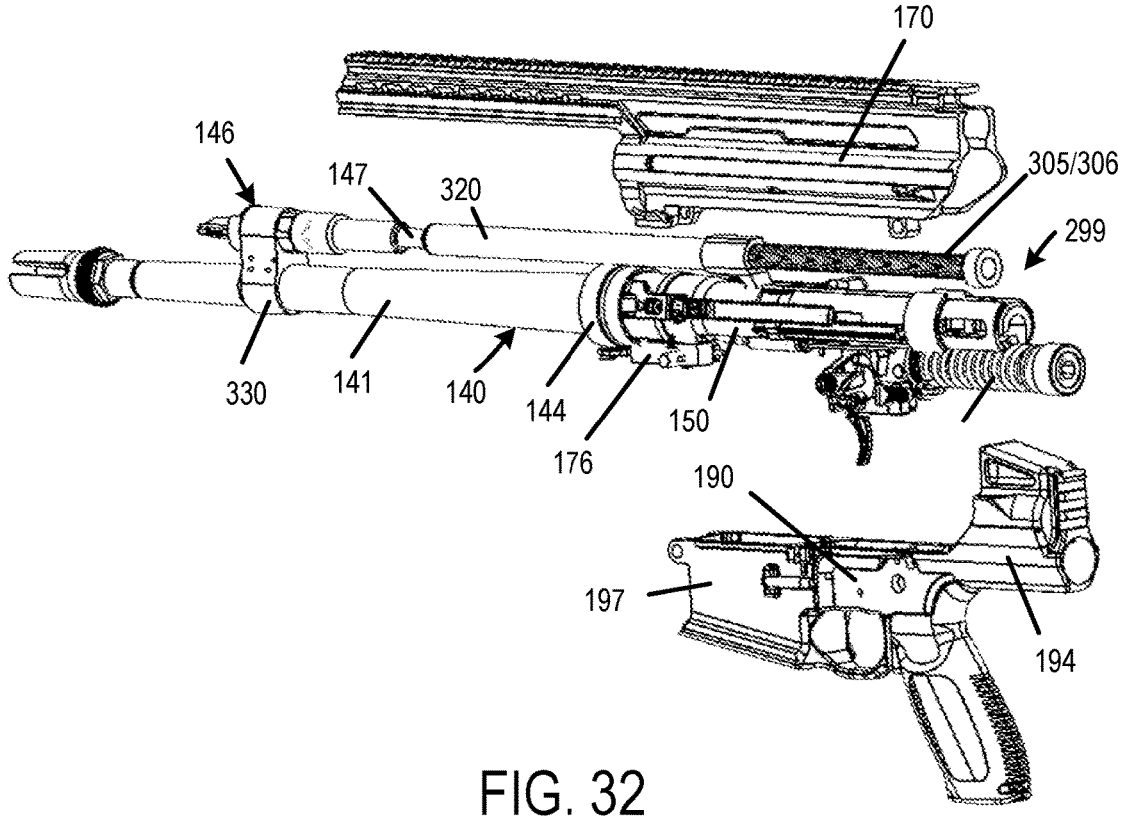
FIG. 32 is an exploded perspective view showing the right and rear sides of some component groups the rifle of FIG. 30, in accordance with an embodiment of the present disclosure.
Figure 33:
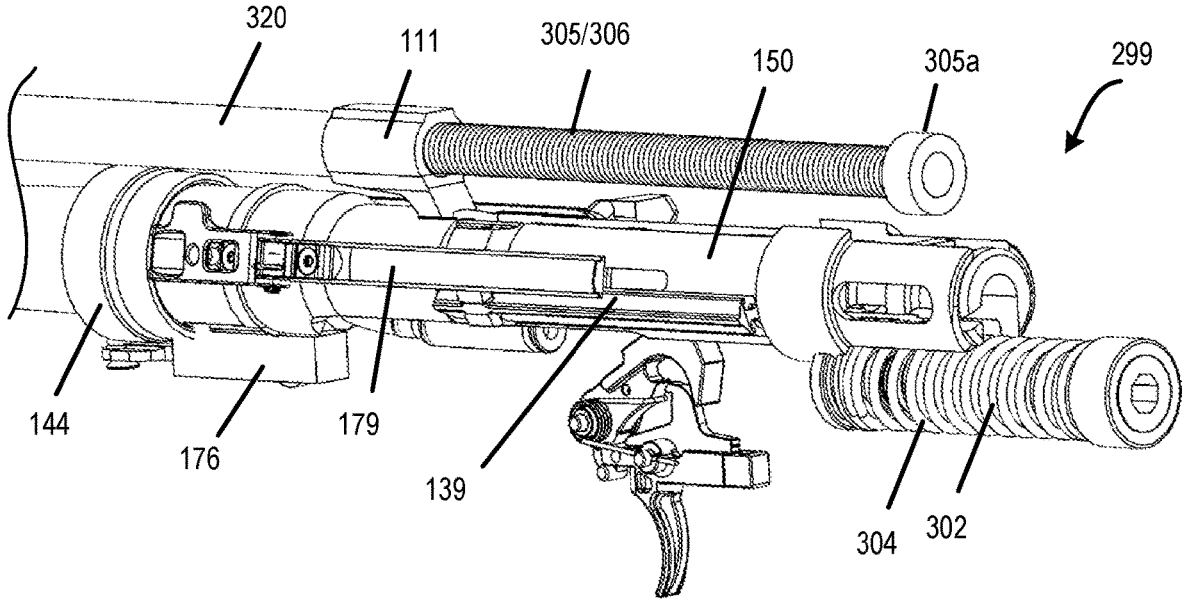
FIG. 33 is a perspective view showing left and rear sides of a recoil assembly and barrel assembly for the rifle of FIG. 30, in accordance with an embodiment of the present disclosure.

FIG. 32 illustrates an exploded perspective view showing the left and rear sides of some components of rifle 100 of FIGS. 30-31, including the upper receiver 170, the lower receiver 190, the barrel group 140, and the recoil assembly 299. Components of the recoil assembly 299 are also shown in the close-up view of FIG. 33. The barrel group 140 includes the barrel 141 attached to the barrel extension 150 with a barrel nut 144. The distal end portion of the barrel extension 150 engages a battery lug 176, which is pinned to the lower receiver 190 adjacent the magazine well. In some embodiments, the barrel assembly 140 can move axially along the battery lug 176. A gas piston assembly 146 includes a gas block 300 mounted on the barrel 141, where the bore of the barrel 141 communicates with the gas block to actuate a gas piston 147. An op-rod 320 is coupled at its distal end to the gas piston 147 and is pivotably coupled at it proximal end to the bolt actuator by a connector 111. A spring guide 305 and op-rod spring 306 extend between the connector 111 and the proximal end portion 194 of the lower receiver 190. The proximal end 305*a* of the spring guide 305 abuts the proximal end portion 194 of the lower receiver 190 in the assembled form. The recoil assembly 299 includes a hydraulic buffer 302 offset from (e.g., located vertically below) the barrel extension 150. A protrusion 158 on the barrel extension 150 engages the hydraulic buffer 302. For example, a flange-like protrusion 158 on the barrel extension 150 engages and mates with a rim on the distal end of the hydraulic buffer 302 and/or buffer spring 304. The hydraulic buffer 302 is at least partially received in the proximal end portion 194 of the lower receiver 190 in the assembled form of the rifle 100. An extractor 139 and charger 179 are mounted along the left side of the barrel extension 150.

Figure 34:
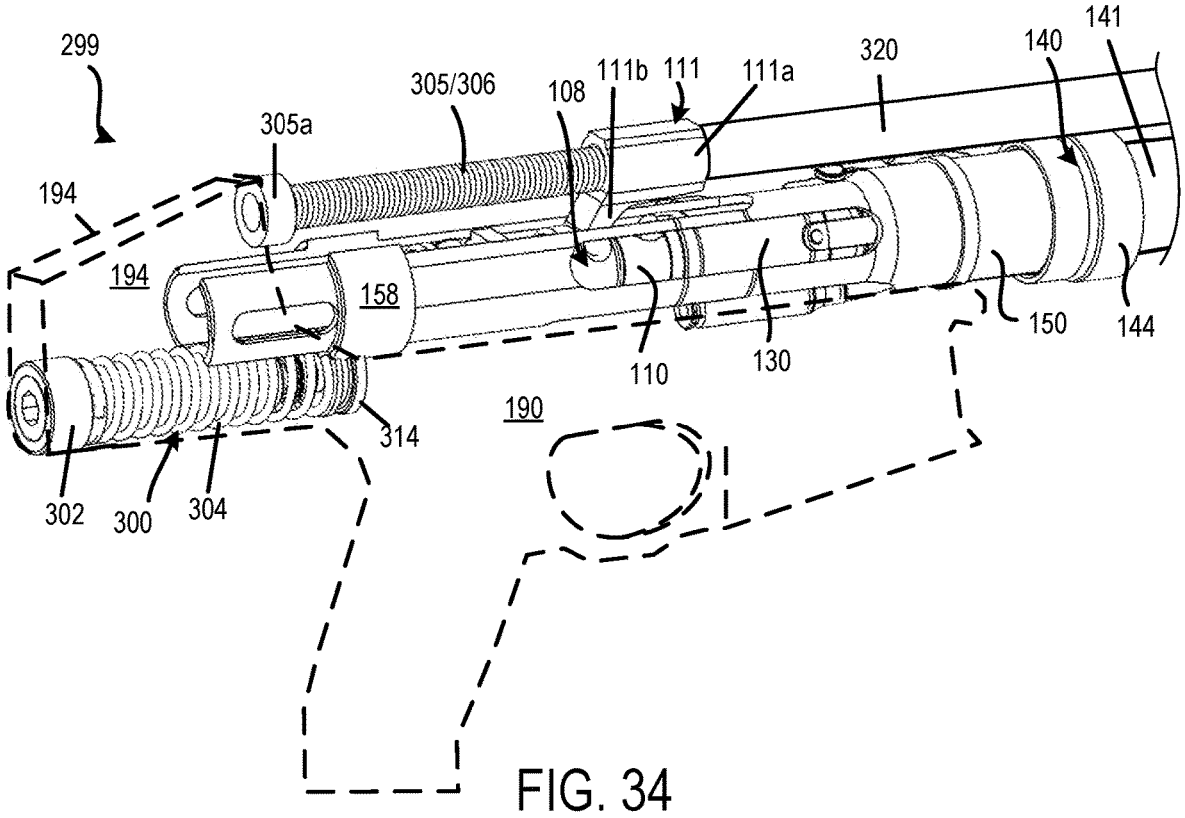
FIG. 34 is a perspective view showing the right and rear sides of portions of the recoil assembly and barrel extension of FIG. 33 along with an outline of the lower receiver, in accordance with an embodiment of the present disclosure.

Referring to FIG. 34, a perspective view illustrates the top, right, and rear sides of a recoil assembly 299, in accordance with an embodiment of the present disclosure. The lower receiver 190 is shown in broken lines to show the relative positions of the recoil assembly 299 and the lower receiver 190. In this embodiment, the bolt group 108 (including bolt 130 and bolt actuator 110) is slidably received in the barrel extension 150. The op-rod 320 is pivotably connected to the bolt actuator 110 by a connector 111. For example, the connector 111 has a body 111*a* constructed to receive the op-rod 320 and has an arm 111*b* or protrusion that extends from the body 111*a* to engage the bolt actuator 110. In some embodiments, the bolt actuator 110 defines a transverse slot 135 having a circular profile. The arm 111*b* of the connector 111 terminates in a corresponding profile such that the connector 111 can pivot about the joint with the transverse slot 135. Other types of pivoting joints can be used between the connector 111 and bolt actuator 110, such as a hinge joint, a ball-and-socket joint, to name a few examples. Further, the connector 111 can be integral to op-rod 320 or to the bolt actuator 110, or may be omitted, in accordance with some embodiments.

In one embodiment, a spring guide 305 extends rearwardly from the connector 111 with the proximal end 305*a* of the spring guide 305 abutting the proximal end portion 194 of the lower receiver 190 during use. In some embodiments, the spring guide 305 is a portion of the op-rod 320. The op-rod spring 306 is installed on the spring guide 305 and compresses when the bolt group 108 moves rearwardly. Upon firing the rifle 100, the bolt group 108 moves rearwardly along the inside of the barrel extension 150 against the spring force of the op-rod spring 306, which is positioned between the proximal end portion 194 of the lower receiver 190 and the connector 111. In some embodiments, the bolt actuator 110 may make contact with the wall of the barrel extension 150 as the bolt group 108 continues rearward, transferring momentum to the barrel assembly 140. In response to recoil forces generated by firing the rifle, combined with any rearward momentum transferred from the bolt group 108, the barrel assembly 140 also moves rearwardly in direct or indirect engagement with the hydraulic buffer assembly 300. As noted above, the protrusion 158 on the barrel extension 150 can engage the actuator 314 of the hydraulic buffer 302, in accordance with some embodiments. The barrel extension 150 may also engage the buffer spring 304. The rearward momentum of the barrel group 140 is absorbed at least in part by the hydraulic buffer 302 located vertically below the barrel extension 150. Rearward momentum of the bolt 130 and bolt actuator 110 is absorbed at least in part by the op-rod spring 306. Thus, recoil forces are absorbed and/or dissipated by a combination of counteracting forces provided by the op-rod spring 306 acting on the bolt group 108, and by the hydraulic buffer 302 and buffer spring 304 of the buffer assembly 300 acting on the barrel assembly 140. By coupling the barrel extension 150 to the hydraulic buffer assembly 300, felt recoil can be greatly reduced, in accordance with some embodiments.

Figure 35:
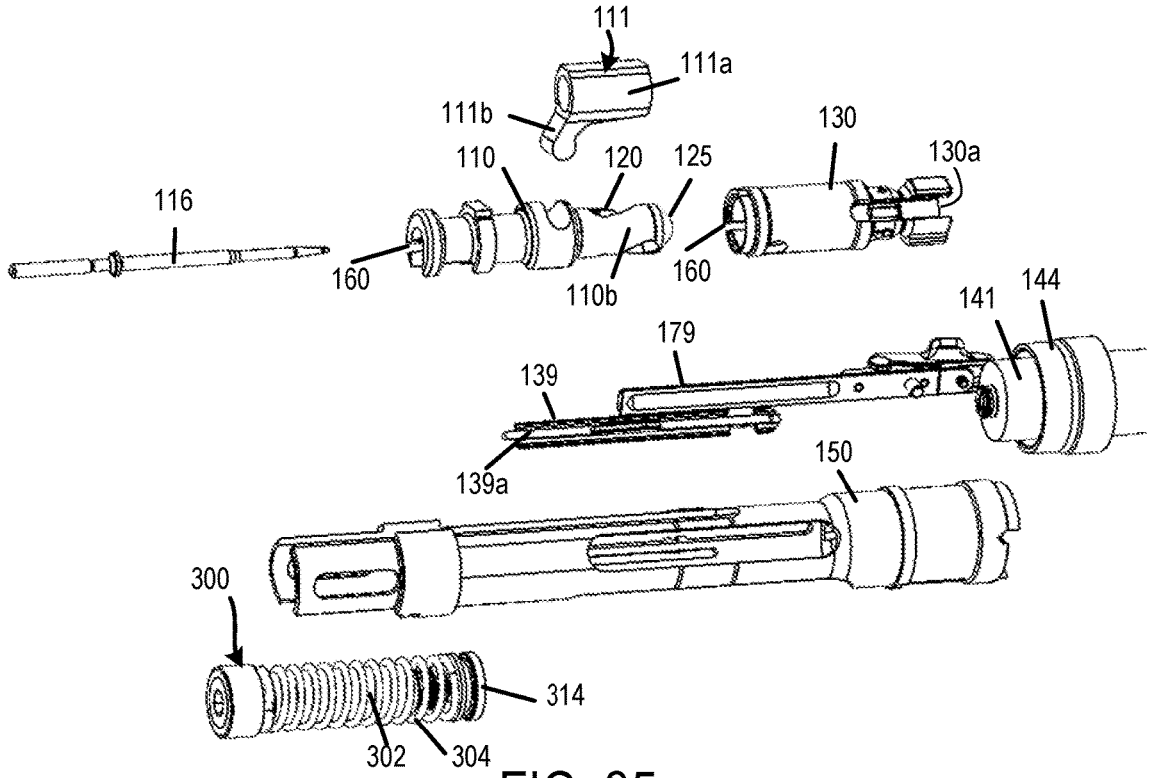
FIG. 35 is an exploded perspective view showing the right and rear sides of components of a recoil assembly, a bolt group, and a barrel assembly, in accordance with an embodiment of the present disclosure.

FIG. 35 illustrates an exploded perspective view showing the right and rear sides of some components of the recoil assembly 299, in accordance with an embodiment of the present disclosure. Components of the bolt group 108 are shown, which includes the bolt 130, bolt actuator 110, and firing pin 116 (the cam pin 122 is not shown for clarity of illustration). The charger 179 and extractor 139 are shown separate from the barrel extension 150. Note that the extractor 139 defines a protrusion 139*a* that is shaped and configured to be received in an extractor slot 160 defined in and extending along the bolt 130 and bolt actuator 110. The buffer assembly 300 includes a hydraulic buffer 302 and a buffer spring 304, both of which can be actuated by the actuator 314 at the distal end of the buffer assembly 300.

In accordance with an embodiment of the present disclosure, the bolt actuator 110 has a conical surface 125 on the distal end portion 110*b* that is positioned distally of the helical cam slot 120. After the bolt actuator 110 has rotated the bolt 130 to lock, the conical surface 125 engages a corresponding conical surface in the bolt 130 (not visible). The conical surface on the bolt 130 serves as a forward stop for the bolt actuator 110. In some embodiments, the extractor slot 160 extends into the conical surfaces 125 of the bolt 130 and bolt actuator 110, which creates non-symmetrical stiffness. The combination of non-symmetrical stiffness and conical taper results in minimizing or eliminating bolt actuation bounce, thereby ensuring consistent position of the bolt actuator 110 upon firing, in accordance with some embodiments.

Figure 36:
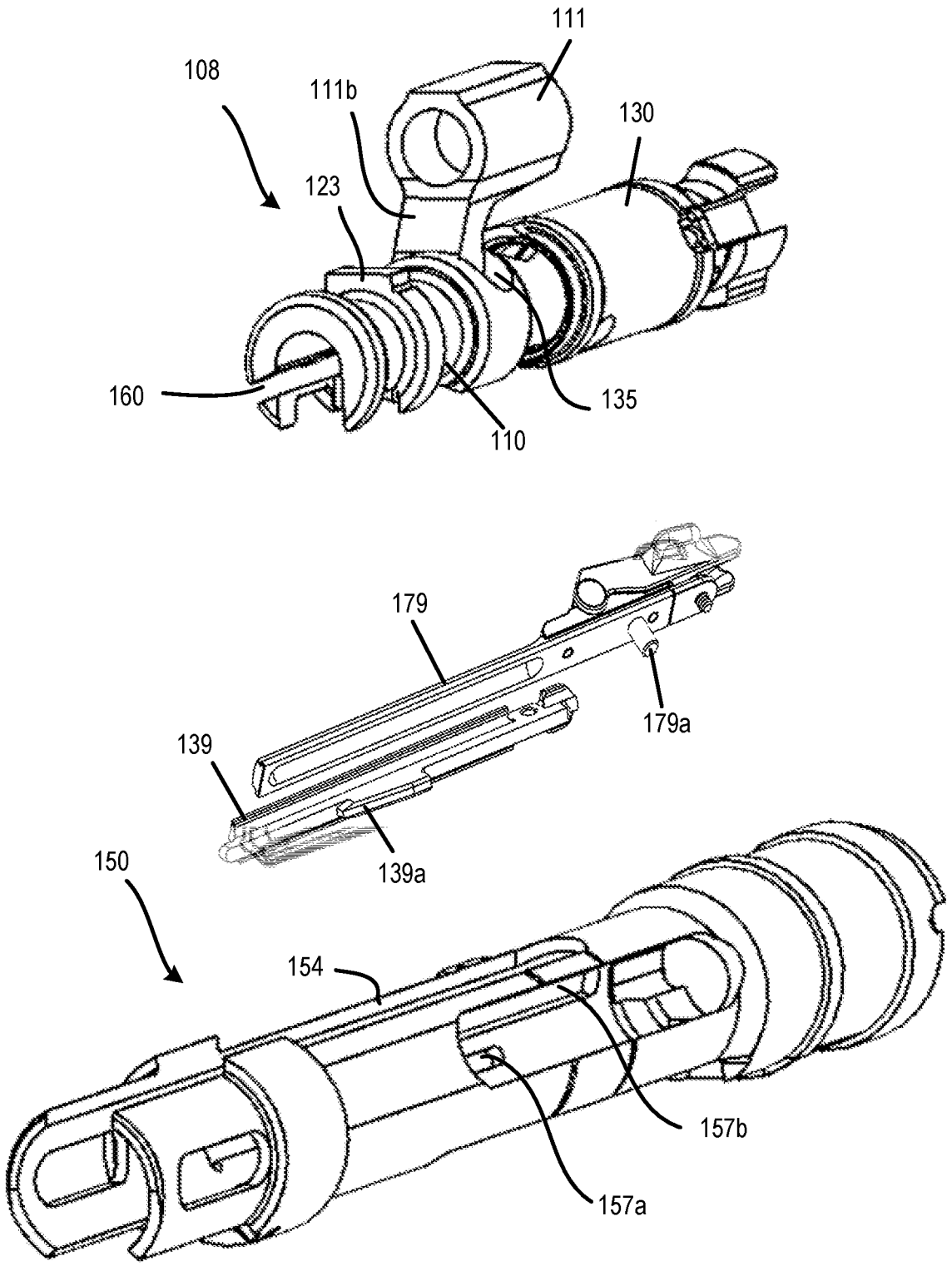
FIG. 36 is a perspective view showing the right and rear sides of a bolt group, a charger, an extractor, and a barrel extension, in accordance with some embodiments of the present disclosure.

FIG. 36 illustrates a perspective view showing the right and rear sides of the bolt group 108, the extractor 139 and charger 179, and the barrel extension 150, in accordance with an embodiment of the present disclosure. Here, the bolt group 108 is shown in assembled form with the bolt actuator 110 received in the bolt body 132. The arm 111*b* of the connector 111 is received in the transverse slot 135 defined in the top of the bolt actuator 110. Due to the circular profile of this joint, the connector 111 can pivot up or down as needed. The barrel extension 150 defines an extractor opening 157*a* sized to receive the protrusion 139*a* on the extractor 139. A charging opening 157*b* is sized to receive the charging pin 179*a* that extends laterally from the charger 179. The charging pin 179 is configured to engage the bolt 130 or bolt actuator 110 to move the bolt group 108 to a rearward position (open bolt position) from a closed-bolt position.

Figure 37:
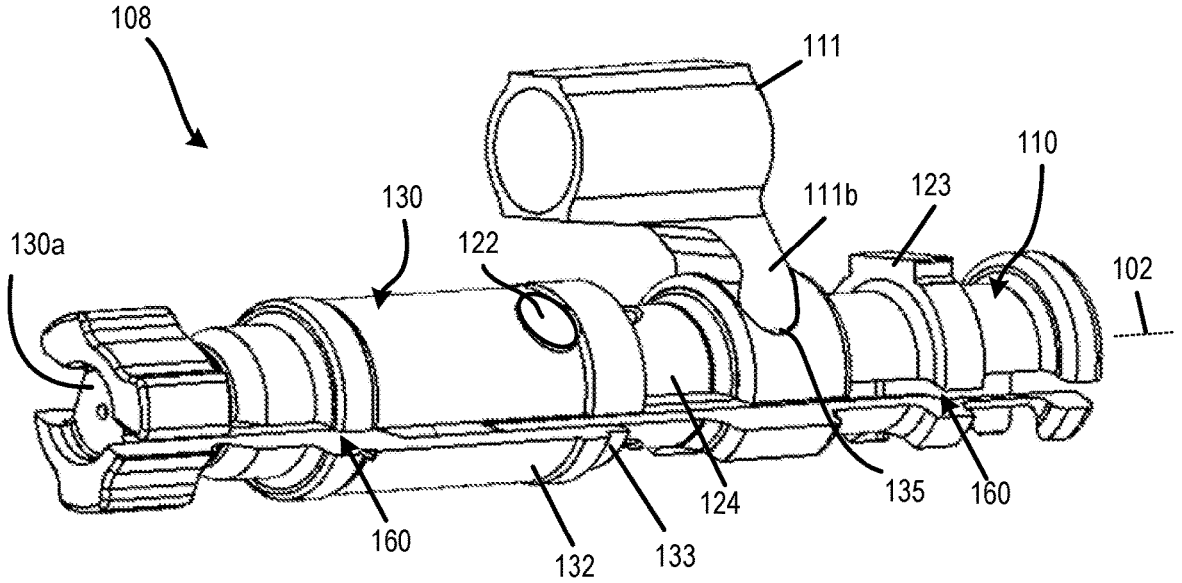
FIG. 37 is a perspective view showing the left and front sides of a bolt group with an op-rod connector pivotably connected to the bolt actuator, in accordance with an embodiment of the present disclosure.
Figure 38:
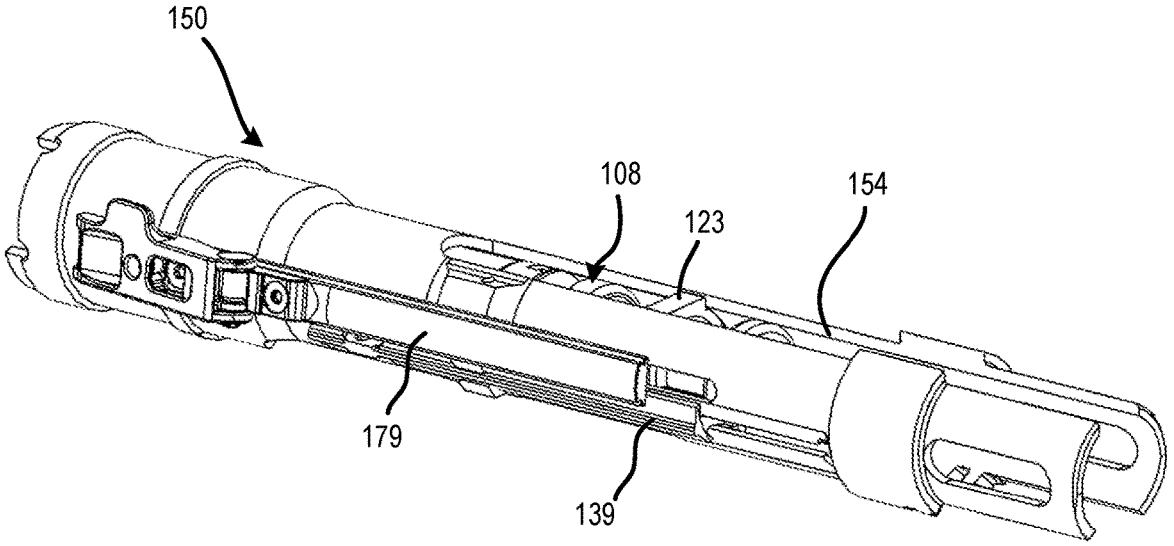
FIG. 38 is a perspective view showing the left and rear sides of a barrel extension with the charger and extractor installed, in accordance with an embodiment of the present disclosure.

FIG. 37 illustrates a perspective view of the bolt group 108 and connector 111 showing the front and left sides, including the bolt face 130*a*; FIG. 38 is a perspective view showing the top, left, and rear sides of the barrel extension 150 and other components, in accordance with some embodiments of the present disclosure. The bolt actuator 110 is partially received in the hollow bolt body 132 of the bolt 130. The arm 111*b* of connector 111 is engaging the transverse slot 135. When coupled to the op-rod 320, the connector 111 moves the bolt group 108 axially along the barrel extension 150 in a forward or rearward direction. However, movement and rotation of the bolt 130 is guided by features of the barrel extension 150. One guiding feature is the protrusion 123 on the bolt actuator 110 that is shaped and configured to extend upward into and slide along the top slot 154 of the barrel extension 150. Also, the bolt group 108 is sized and constructed to slide along the inside of the barrel extension 150 as guided by its inside surface. Another guiding feature is the extractor 139 attached to the barrel extension 150 and received in the extractor slot 160 extending along the bolt 130 and bolt actuator 110. When the protrusion 139*a* on the extractor 139 occupies the extractor slot 160, the bolt 130 is prevented from rotating. In other positions, the bolt 130 may clear the protrusion 139*a* on the extractor 139, thereby allowing the bolt 130 to rotate, such as when the protrusion 139*a* aligns with a region of reduced diameter 124 on the bolt actuator 110 and recess 133 at the proximal end the bolt 130.

The bolt 130 features an axial extractor slot 160 along the outside surface. Part of the outside surface along the proximal bolt end portion 132*a* defines a recess 133 or relief above or below the extractor slot 160. As the bolt 130 moves into battery, the recess 133 clears the ejector 139, freeing the bolt 130 to rotate about the bore axis 102. After firing, the op-rod 320 moves the bolt actuator 110 rearward faster that the bolt 130, causing relative motion between the bolt 130 and bolt actuator 110, an in turn causing the cam pin 122 to rotate through the helical slot 120 and rotate the bolt 130 until it is unlocked. Once the bolt 130 is unlocked, it moves reward and the extractor slot 160 re-engages the ejector 139, which is fixed to the barrel extension 150.

In use, embodiments of the present disclosure as variously described herein have advantages over existing firearms and rifle assemblies. An advantage of some embodiments is coupling the barrel extension 150 to the hydraulic buffer assembly 300. In doing so, a greater portion of the recoil forces are dissipated by the recoil assembly 299, unlike existing recoil assemblies that act only on the bolt and bolt carrier. As a result, the operator has reduced felt recoil, which improves control and precision of the rifle. In some embodiments, the recoil assembly 299 reduces felt recoil by 50% or more, 60% or more, 70% or more, 80% or more, or about 85% compared to the same rifle with a barrel assembly 140 fixed to the receiver. In one example rifle using a closed bolt gas piston system, the recoil energy is reduced from 6.6 ft.-lbs. to about 2.1 ft.-lbs., which is comparable to that of an M4 rifle firing 5.56×45 NATO ammunition.

Another advantage of some embodiments is that the hydraulic buffer assembly is housed in the lower receiver or trigger housing. This feature allows the rifle 100 to have a folding stock 260 since there is no buffer tube, as is the case with other rifle assemblies. As a result, the rifle 100 can have a shorter overall length when the stock 260 is folded. For example, by locating the buffer assembly to be below the proximal end of the barrel extension 150, the stock 260 can be moved forward towards the bolt to shorten the overall length of the rifle to about 31 inches with a 16-inch barrel 141.

Another advantage of some embodiments is that the longer barrel extension 150 allows the use of a bolt group 108 with larger lugs 138. The larger lugs 138 in turn enable increased chamber pressures. For example, the barrel extension 150 is sized to accommodate the bolt group 108 during forward and rearward travel.

Another advantage of some embodiments is using the barrel extension to guide the movement of the bolt 150. The barrel extension 150 provides better guidance of the bolt 130 and allows for looser tolerances in the bolt, barrel extension, and other components. In some such embodiments, the bolt actuator 110 functions to push the bolt forward and backward, but movement and rotation is guided by the barrel extension 150. The barrel extension 150 also enables the use of a larger bolt 130, which in turn enables the use of higher chamber pressures.

Another advantage of some embodiments is a reduced loading on the bolt 130 due to recoil forces since the bolt actuator 110 engages the buffer assembly 299 and dissipates some of the recoil forces acting on the bolt 130 and bolt actuator 110.

Another advantage of some embodiments is that the barrel 141 stops on the battery lug 179 for consistent barrel position on firing. This feature results in improved shooting precision.

Another advantage of some embodiments is a shoulder-fired rifle 100 that has a larger bolt 130 and operates with increased chamber pressure, where the rifle is within current weight limitations for soldiers. For example, the rifle 100 is a shoulder-fired rifle with a weight of 11.5 pounds or less, including 10.5 pounds or less. Additionally, the rifle 100 can be configured with familiar controls found on the AR-15/AR-10 platform or other rifle platform.

Another advantage of some embodiments is using a floating barrel assembly 140. Excess energy of the barrel assembly 140 is mitigated by the recoil assembly 299. Additionally, in some embodiments, some excess energy of the bolt 130 and bolt actuator 110 is transferred to the buffer assembly 300 via the barrel extension 150.

Further Example Embodiments

The following examples pertain to further embodiments, from which numerous permutations and configurations will be apparent.

Example 1 is a recoil assembly for a rifle, the assembly comprising a rifle receiver defining a primary longitudinal opening and a secondary bore offset from the primary longitudinal opening, a barrel assembly slidably received in the primary longitudinal opening and extending along a primary bore axis, the barrel assembly including a barrel secured to a barrel extension, a bolt group slidably received in the barrel extension, the bolt group including a bolt actuator coupled to a bolt, a gas piston assembly attached to the barrel and in fluid communication with the secondary bore, the gas piston assembly having a gas piston axially displaceable in response to pressurized gas in the barrel, an operational rod having a distal end housed in the secondary bore and arranged for actuation by the gas piston and having a proximal end coupled to the bolt actuator, and a hydraulic buffer assembly engaging a proximal end portion of the barrel extension.

Example 2 includes the subject matter of Example 1, wherein the hydraulic buffer and spring assembly is offset from the bore axis.

Example 3 includes the subject matter of Example 2, wherein the hydraulic buffer assembly is located in the secondary bore.

Example 4 includes the subject matter of any of Examples 1-3, wherein the bolt actuator is received in a hollow proximal end portion of the bolt.

Example 5 includes the subject matter of any of Examples 1-4, wherein the operational rod is axially aligned with the hydraulic buffer assembly, and the recoil assembly further comprises a spring guide extending between the operational rod and a hydraulic buffer of the hydraulic buffer assembly, wherein the hydraulic buffer resists rearward motion of the operational rod; and an op-rod spring on the spring guide, wherein the op-rod spring resists rearward motion of the bolt actuator.

Example 6 includes the subject matter of Example 5, wherein the rifle is a machine gun with an open bolt configuration.

Example 7 includes the subject matter of any of Examples 1-6 and further comprises a rifle receiver defining a longitudinal opening, wherein the barrel extension is slidably received in the longitudinal opening.

Example 8 includes the subject matter of any of Examples 1-4, wherein the barrel and barrel extension are free floating with respect to the receiver.

Example 9 includes the subject matter of Example 8, wherein the receiver is an upper receiver and the operational rod is offset from the hydraulic buffer assembly, and wherein the recoil assembly further comprises a lower receiver assembled with the upper receiver, the lower receiver having a proximal end portion, the hydraulic buffer assembly at least partially received in the proximal end portion of the lower receiver; a spring guide extending between the operational rod and the proximal end portion of the lower receiver; and a op-rod spring on the spring guide, wherein the op-rod spring resists rearward movement of the bolt actuator.

Example 10 includes the subject matter of Example 9, wherein the rifle has a closed bolt configuration.

Example 11 includes the subject matter of Example 9 or 10, wherein the operational rod and the spring guide are located above and extend along the barrel and barrel extension, respectively.

Example 12 includes the subject matter of any of Examples 1-11 and further comprises a connector between the op-rod and the bolt actuator, wherein the connector defines a cylindrical joint with the bolt actuator, the cylindrical joint communicating only axial movement between the operational rod and the bolt actuator.

Example 13 includes the subject matter of any of Examples 1-12, wherein axial and rotational movement of the bolt is guided by the barrel extension.

Example 14 includes the subject matter of any of Examples 1-13, wherein upon firing the rifle, recoil forces move the bolt, the bolt actuator, the barrel, and the barrel extension rearwardly with respect to the receiver, and wherein the recoil forces are counteracted at least in part by a combination of the hydraulic buffer assembly acting on the barrel extension and the op-rod spring acting on the bolt actuator.

Example 15 includes the subject matter of Example 14, wherein the hydraulic buffer assembly includes a buffer spring and a hydraulic buffer, the buffer spring positioned to resist rearward movement of the barrel extension, and wherein the op-rod spring resists rearward movement of the bolt actuator.

Example 16 includes the subject matter of any of Examples 1-4 and 7-12, wherein upon firing the rifle, recoil forces move the bolt, the bolt actuator, the barrel, and the barrel extension rearwardly with respect to the receiver; and wherein the recoil forces are counteracted at least in part by a combination of the hydraulic buffer assembly acting on the barrel extension and the op-rod spring acting on the bolt actuator; and wherein the hydraulic buffer additionally resists rearward movement of the bolt actuator.

Example 17 includes the subject matter of any of Examples 1-16, wherein the recoil assembly dissipates recoil forces by acting on both the barrel extension and the bolt actuator.

Example 18 is a recoil assembly for a rifle, the assembly comprising a receiver defining a longitudinal opening therethrough; a barrel extension movably received in the longitudinal opening of the receiver; a barrel secured to a distal end of the barrel extension, the barrel defining a bore with a bore axis; a hydraulic buffer assembly below a proximal end portion of the barrel extension, the hydraulic buffer assembly operatively coupled to the barrel extension; a bolt actuator in the barrel extension and movable along an inside of the barrel extension; a bolt in the barrel extension distally of the bolt actuator, a proximal end portion of the bolt defining a recess extending axially therein, wherein a distal end portion of the bolt actuator is received in the recess in proximal end portion of the bolt, and wherein the bolt is movable in the barrel extension along the bore axis; a gas piston assembly attached to the barrel and in fluid communication with the bore, the gas piston assembly having a gas piston axially displaceable in response to pressurized gas in the bore; an operational rod coupled to the bolt actuator via a connector; and a spring guide with a op-rod spring coiled along the spring guide, the spring guide coupled to the connector.

Example 19 includes the subject matter of Example 18, wherein the receiver is an upper receiver and further comprises a lower receiver assembled to the upper receiver, wherein the spring guide extends between a proximal end portion of the lower receiver and the operational rod, and wherein the hydraulic buffer assembly is at least partially received in the proximal end portion of the lower receiver.

Example 20 includes the subject matter of Example 18 or 19, wherein the connector defines a cylindrical connection with the bolt actuator, the cylindrical connection communicating only axial movement between the operational rod and the bolt actuator.

Example 21 includes the subject matter of any of Examples 18-20, wherein axial and rotational movement of the bolt is guided by the barrel extension.

Example 22 includes the subject matter of any of Examples 18-21, wherein the barrel and barrel extension are free floating with respect to the receiver.

Example 23 includes the subject matter of any of Examples 18-22, wherein the hydraulic buffer assembly includes a hydraulic buffer and a buffer spring.

Example 24 includes the subject matter of Example 23, wherein the barrel extension engages the buffer spring and the spring guide engages the hydraulic buffer.

Example 25 includes the subject matter of any of Examples 18-23, wherein upon firing the rifle, recoil forces move the bolt, the bolt actuator, the barrel, and the barrel extension rearwardly with respect to the receiver, and wherein the recoil forces are countered at least in part by a combination of the hydraulic buffer assembly and the op-rod spring, and wherein the buffer spring acts on the barrel extension and the op-rod spring acts on the bolt actuator.

Example 26 includes the subject matter of Example 25, wherein the hydraulic buffer counteracts recoil forces on the bolt actuator.

Example 27 includes the subject matter of any of Examples 18-26, wherein the operational rod is aligned with the hydraulic buffer.

Example 28 includes the subject matter of any of Examples 18-27, wherein the op-rod spring and the hydraulic buffer assembly are arranged in series.

Example 29 includes the subject matter of any of Examples 18-23, wherein the op-rod spring and the hydraulic buffer assembly are arranged in parallel.

Example 30 includes the subject matter of any of Examples 18-29, wherein the recoil assembly acts to counter recoil forces at least in part by acting on the barrel extension and on the bolt actuator.

Example 31 includes the subject matter of any of Examples 18-30, wherein upon firing the rifle, recoil forces move the bolt, the bolt actuator, the barrel, and the barrel extension rearwardly with respect to the receiver, and wherein the recoil forces are countered at least in part by a combination of the hydraulic buffer assembly acting on the barrel extension and the op-rod spring acting on the bolt actuator.

Example 32 is a bolt assembly comprising a bolt actuator having an actuator body extending from a proximal actuator end portion to a distal actuator end portion, the distal actuator end portion defining a firing pin opening; and a bolt with a proximal bolt end portion and a distal bolt end portion, wherein the proximal bolt end portion is constructed and arranged to receive the distal actuator end portion therein, and wherein the distal bolt end portion defines a plurality of lugs.

Example 33 includes the subject matter of Example 32, wherein the proximal bolt end portion defines a transverse through opening, wherein the actuator body defines a helical slot therethrough, and wherein the bolt assembly includes a cam pin sized to extend through the transverse through opening and through the helical slot when the distal actuator end portion is received in the bolt such that when the cam pin is installed through the transverse through opening and the helical slot, the bolt and the bolt actuator are coupled to permit relative axial and rotational movement between the bolt and the bolt actuator.

Example 34 includes the subject matter of Example 32 or 33, wherein each of the bolt and the bolt actuator define an extractor slot extending along an outside surface.

Example 35 includes the subject matter of any of Examples 32-34 further comprising a firing pin retained in the bolt actuator and extending along a central axis.

Example 36 includes the subject matter of Example 35, wherein a distal end of the bolt actuator defines a conical surface and an inside of the bolt body defines a corresponding conical surface, wherein when the conical surface engages the corresponding conical surface, the firing pin extends through a distal face of the bolt.

Example 37 includes the subject matter of any of Examples 32-36, wherein the bolt actuator defines a recess in an outside of the actuator body, the recess extending transversely to the actuator body and having a circular profile.

Example 38 includes the subject matter of Example 37 and further comprises a connector having a connector body and having a connector arm extending from the connector body, wherein an end of the connector arm is shaped to engage and mate with the recess in the outside of the actuator body.

Example 39 includes the subject matter of Example 37 or 38, wherein the recess is located along a top surface of the actuator body.

Example 40 includes the subject matter of Example 37 or 38, wherein the recess is located along a bottom surface of the actuator body.

Example 41 includes the subject matter of Example 40 and further comprises a cylindrical guide extending up from a top surface of the proximal actuator end portion.

Example 42 includes the subject matter of Example 41, wherein the cylindrical guide includes a roller.

Example 43 includes the subject matter of Example 40 and further comprises a rammer attached to and extending longitudinally along a top of the bolt, the rammer protruding upward from the bolt.

Example 44 includes the subject matter of Example 43, wherein the rammer extends longitudinally between lugs on the distal bolt end portion, and wherein the rammer is pivotably attached to the bolt.

Example 44 includes the subject matter of any of Examples 41-44 and further comprises a feed tray configured to receive belt-fed ammunition; and a feed cam operatively coupled to the cylindrical guide, the feed cam having a distal end portion adjacent the feed tray; wherein reciprocating axial movement of the cylindrical guide causes reciprocating lateral movement of a distal end portion of the feed cam.

Example 46 is a rifle including the recoil assembly of any of Examples 1-8, 12-28, or 30-31.

Example 47 includes the subject matter of Example 46, wherein the rifle is a machine configured for open bolt operation.

Example 48 includes the subject matter of Example 46 or 47 further comprising a folding stock attached to a proximal end of the lower receiver.

Example 48 is a rifle including the recoil assembly of any of Examples 1-4, 7-15, 17-23, 25, or 29-31.

Example 49 includes the subject matter of Example 48, wherein the rifle is a semi-automatic or automatic rifle configured for closed bolt operation.

Example 50 includes the subject matter of Example 48 or 49 and further comprises a folding stock attached to a proximal end of the lower receiver.

Example 51 is a receiver assembly for a rifle, the assembly comprising a receiver having a feed assembly configured for open-bolt operation; and a feed cover hingedly mounted to the receiver and including a portion of the feed assembly. The feed cover is movable between a closed position and an open position by pivoting about one or more hinge pins oriented along a longitudinal axis of the rifle receiver.

Example 52 includes the subject matter of Example 51, wherein the feed cover includes one or more hinge leaves extending away from a bottom of the feed cover, each of the hinge leaves defining a pin opening configured to receive part of the hinge pin.

Example 53 includes the subject matter of Example 52 and further comprises one or more hinge pin receptacles on a side of the rifle receiver, each hinge pin receptacle corresponding to one of the one or more hinge leaves, wherein the hinge pin receptacles and the hinge leaves are part of a hinge between the feed cover and the rifle receiver.

Example 54 includes the subject matter of Example 53, wherein the hinge leaves include a first hinge leaf on a distal portion of the feed cover and a second hinge leaf on a proximal portion of the feed cover.

Example 55 includes the subject matter of Example 54, wherein the hinge pin includes a first hinge pin extending in the first hinge leaf and a second hinge pin extending in the second hinge leaf.

Example 56 includes the subject matter of Example 55, wherein the receiver includes a distal hinge pin receptacle corresponding to the first hinge leaf and a proximal hinge pin receptacle corresponding to the second hinge leaf, the distal and proximal hinge pin receptacles configured to receive part of the first or second hinge pin.

Example 57 includes the subject matter of any of Examples 51-56 and further comprises a first mounting rail portion extending along a top side of the feed cover and a second mounting rail portion extending along a top side of the receiver, wherein the first mounting rail portion and the second mounting rail portion define a continuous segmented mounting rail when the feed cover is in the closed position.

Example 58 includes the subject matter of Example 57 and further comprises a hand guard attached to the receiver and positioned distally of the feed cover and a third mounting rail portion extending along a top of the hand guard, where the third mounting rail portion is part of the continuous segmented mounting rail when the feed cover is in the closed position.

Example 59 includes the subject matter of any of Examples 51-58 and further comprises a feed guide on an underside of the feed cover, the feed guide configured to engage ammunition fed into the feed assembly; a slide on the underside of the feed cover, the slide movable laterally across the underside of the feed cover; a cam link operationally coupled to the slide; and a spring operatively coupled to the cam link, the spring biasing the slide towards one side of the feed cover.

Example 60 includes the subject matter of Example 59 and further comprises a feed cam having a proximal end portion housed in the rifle receiver and a distal end portion configured to engage the cam link when the feed cover is in the closed position and disengage from the cam link when the cover is in the open position; and a bolt assembly movable axially along an inside of the receiver, the bolt assembly including a feed guide configured to engage the feed cam as the bolt assembly moves between a battery position and a recoil position; wherein reciprocating axial movement of the bolt assembly between the battery position and the recoil position causes reciprocating lateral movement of the distal end portion of the feed cam.

Example 61 includes the subject matter of Example 60, wherein the feed guide includes a roller.

Example 62 includes the subject matter of any of Examples 60 or 61, wherein, when the cam link engages the feed cam, reciprocating axial movement of the bolt assembly causes reciprocating lateral movement of the cam link and slide.

Example 63 includes the subject matter of any of Examples 60-62, wherein the cam link includes a tongue, the tongue configured to be received in a receptacle defined on a distal end of the feed cam, the distal end of the feed cam having a sloped surface extending to the receptacle such that the tongue can be guided along the sloped surface and into the receptacle when charging the rifle.

Example 64 includes the subject matter of Example 51-63 and further comprises a trigger housing assembled with the receiver; a lug on the receiver; a barrel assembly including a barrel coupled to a barrel extension, the barrel assembly slidably received in a longitudinal opening in the receiver, wherein the barrel assembly includes a surface constructed to contact the lug to stop forward movement of the barrel assembly; and a bolt assembly slidably received in the barrel extension, the bolt assembly including a bolt actuator movably coupled to a bolt.

Example 65 includes the subject matter of Example 64, wherein the bolt actuator is slidably received in the bolt, and wherein the feed guide is on the bolt actuator.

Example 66 includes the subject matter of Example 65 and further comprises a gas piston assembly attached to the barrel and in fluid communication therewith, the gas piston assembly having a gas block and a gas piston axially displaceable in the gas block in response to pressurized gas in the barrel; an operational rod having a distal end arranged for actuation by the gas piston, the operational rod having a proximal end coupled to the bolt actuator; and a hydraulic buffer assembly engaging the barrel extension, wherein the hydraulic buffer assembly is offset from a bore axis and arranged to resist rearward movement of the barrel assembly.

Example 67 includes the subject matter of Example 66, wherein the hydraulic buffer assembly is below the bore axis and has a distal end coupled to the barrel extension and a proximal end coupled to the trigger housing.

Example 68 includes the subject matter of Example 66 or 67, wherein the operational rod is axially aligned with the hydraulic buffer assembly, and further comprising: a spring guide extending between the operational rod and a hydraulic buffer of the hydraulic buffer assembly, wherein the hydraulic buffer resists rearward motion of the operational rod; and an operational rod spring on the spring guide, wherein the operational rod resists rearward motion of the bolt actuator.

Example 69 is a rifle comprising the receiver assembly of any of Examples 51-68.

Example 70 includes the subject matter of Example 69, wherein the rifle is a machine gun with an open-bolt configuration.

The embodiments of the disclosure and the various features thereof are discussed with reference to the non-limiting embodiments and examples that are illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the disclosure. The examples used herein are intended merely to facilitate an understanding of ways in which the disclosure can be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings unless otherwise noted.

It is understood that the disclosure is not limited to the particular methodology, devices, apparatus, materials, applications, etc., described herein, as these may vary. It is also to be understood that the terminology used herein is used for the purpose of describing particular embodiments only and is not intended to limit the scope of the disclosure. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this disclosure belongs. Preferred methods, devices, and materials are described, although any methods and materials similar or equivalent to those described herein can be used in the practice or testing of the disclosure.

Those skilled in the art will appreciate that many modifications to the embodiments are possible without departing from the scope of the disclosure. In addition, it is possible to use some of the features of the embodiments described without the corresponding use of the other features. Accordingly, the foregoing description of the exemplary embodiments is provided for the purpose of illustrating the principle of the disclosure, and not in limitation thereof, since the scope of the disclosure is defined solely by the appended claims.

What is claimed is:

1. A receiver assembly for a rifle, the assembly comprising:

a rifle receiver having a feed assembly configured for open-bolt operation; and a feed cover hingedly mounted to the receiver and including a portion of the feed assembly, wherein the feed cover is movable between a closed position and an open position by pivoting about a hinge pin oriented along a longitudinal axis of the rifle receiver.

2. The receiver assembly of claim 1, wherein the feed cover includes one or more hinge leaves extending away from a bottom of the feed cover, each of the one or more hinge leaves defining a pin opening configured to receive part of the hinge pin.

3. The receiver assembly of claim 2, further comprising one or more hinge pin receptacles on a side of the rifle receiver, each of the one or more hinge pin receptacle corresponding to one of the hinge leaves, wherein the hinge pin receptacles and the hinge leaves are part of a hinge between the feed cover and the rifle receiver.

4. The receiver assembly of claim 3, wherein the one or more hinge leaves include a first hinge leaf on a distal portion of the feed cover and a second hinge leaf on a proximal portion of the feed cover.

5. The receiver assembly of claim 4, wherein the hinge pin includes a first hinge pin extending in the first hinge leaf and a second hinge pin extending in the second hinge leaf.

6. The receiver assembly of claim 5, wherein the one or more hinge pin receptacles include a distal hinge pin receptacle corresponding to the first hinge leaf and a proximal hinge pin receptacle corresponding to the second hinge leaf, the distal and proximal hinge pin receptacles configured to receive part of the first or second hinge pin.

7. The receiver assembly of claim 1 further comprising:

a first mounting rail portion extending along a top side of the feed cover; and a second mounting rail portion extending along a top side of the rifle receiver;

wherein the first mounting rail portion and the second mounting rail portion define a continuous segmented mounting rail when the feed cover is in the closed position.

8. The receiver assembly of claim 7 further comprising:

a hand guard attached to the rifle receiver and positioned distally of the feed cover; and a third mounting rail portion extending along a top of the hand guard, wherein the third mounting rail portion is part of the continuous segmented mounting rail when the feed cover is in the closed position.

9. The receiver assembly of claim 1 further comprising:

a feed guide on an underside of the feed cover, the feed guide configured to engage ammunition fed into the feed assembly;

a slide on the underside of the feed cover, the slide movable laterally across the underside of the feed cover;

a cam link operationally coupled to the slide; and a spring operatively coupled to the cam link, the spring biasing the slide towards one side of the feed cover.

10. The receiver assembly of claim 9 further comprising:

a feed cam having a proximal end portion housed in the rifle receiver and a distal end portion configured to engage the cam link when the feed cover is in the closed position and disengage from the cam link when the cover is in the open position; and a bolt assembly movable axially along an inside of the receiver, the bolt assembly including a feed guide configured to engage the feed cam as the bolt assembly moves between a battery position and a recoil position;

wherein reciprocating axial movement of the bolt assembly between the battery position and the recoil position causes reciprocating lateral movement of the distal end portion of the feed cam.

11. The receiver assembly of claim 10, wherein, when the cam link engages the feed cam, reciprocating axial movement of the bolt assembly causes reciprocating lateral movement of the cam link and slide.

12. The receiver assembly of claim 10, wherein the cam link includes a tongue, the tongue configured to be received in a receptacle defined on a distal end of the feed cam, the distal end of the feed cam having a sloped surface extending to the receptacle such that the tongue can be guided along the sloped surface and into the receptacle when charging the rifle.

13. The receiver assembly of claim 10 further comprising:

a trigger housing assembled with the receiver;

a lug on the receiver;

a barrel assembly including a barrel coupled to a barrel extension, the barrel assembly slidably received in a longitudinal opening in the receiver, wherein the barrel assembly includes a surface constructed to contact the lug to stop forward movement of the barrel assembly; and a bolt assembly slidably received in the barrel extension, the bolt assembly including a bolt actuator movably coupled to a bolt.

14. The receiver assembly of claim 13, wherein the bolt actuator is slidably received in the bolt; and wherein the feed guide is on the bolt actuator.

15. The receiver assembly of claim 14, wherein the feed guide includes a roller.

16. The receiver assembly of claim 13 further comprising:

a gas piston assembly attached to the barrel and in fluid communication therewith, the gas piston assembly having a gas block and a gas piston axially displaceable in the gas block in response to pressurized gas in the barrel;

an operational rod having a distal end arranged for actuation by the gas piston, the operational rod having a proximal end coupled to the bolt actuator; and a hydraulic buffer assembly engaging the barrel extension, wherein the hydraulic buffer assembly is offset from a bore axis and arranged to resist rearward movement of the barrel assembly.

17. The receiver assembly of claim 16, wherein the hydraulic buffer assembly is below the bore axis and has a distal end coupled to the barrel extension and a proximal end coupled to the trigger housing.

18. The receiver assembly of claim 16, wherein the operational rod is axially aligned with the hydraulic buffer assembly, the receiver assembly further comprising:

a spring guide extending between the operational rod and a hydraulic buffer of the hydraulic buffer assembly, wherein the hydraulic buffer resists rearward motion of the operational rod; and an operational rod spring on the spring guide, wherein the operational rod resists rearward motion of the bolt actuator.

19. A rifle comprising the receiver assembly of claim 16.

20. The rifle of claim 19, wherein the rifle is a machine gun with an open-bolt configuration.

* * * * *